US008958710B2

(12) United States Patent
Yuasa et al.

(10) Patent No.: US 8,958,710 B2
(45) Date of Patent: Feb. 17, 2015

(54) FIXING DEVICE, IMAGE FORMING APPARATUS INCORPORATING SAME, AND FIXING METHOD

(71) Applicants: Shuutaroh Yuasa, Kanagawa (JP); Takeshi Uchitani, Kanagawa (JP); Takamasa Hase, Shizuoka (JP); Takuya Seshita, Kanagawa (JP); Hiroshi Yoshinaga, Chiba (JP); Kenji Ishii, Kanagawa (JP); Tadashi Ogawa, Tokyo (JP); Arinobu Yoshiura, Kanagawa (JP); Teppei Kawata, Kanagawa (JP); Toshihiko Shimokawa, Kanagawa (JP); Kensuke Yamaji, Kanagawa (JP); Masaaki Yoshikawa, Tokyo (JP); Masahiko Satoh, Tokyo (JP); Hiromasa Takagi, Tokyo (JP); Takahiro Imada, Kanagawa (JP); Hajime Gotoh, Kanagawa (JP); Akira Suzuki, Tokyo (JP); Shinichi Namekata, Kanagawa (JP); Kazuya Saito, Kanagawa (JP)

(72) Inventors: Shuutaroh Yuasa, Kanagawa (JP); Takeshi Uchitani, Kanagawa (JP); Takamasa Hase, Shizuoka (JP); Takuya Seshita, Kanagawa (JP); Hiroshi Yoshinaga, Chiba (JP); Kenji Ishii, Kanagawa (JP); Tadashi Ogawa, Tokyo (JP); Arinobu Yoshiura, Kanagawa (JP); Teppei Kawata, Kanagawa (JP); Toshihiko Shimokawa, Kanagawa (JP); Kensuke Yamaji, Kanagawa (JP); Masaaki Yoshikawa, Tokyo (JP); Masahiko Satoh, Tokyo (JP); Hiromasa Takagi, Tokyo (JP); Takahiro Imada, Kanagawa (JP); Hajime Gotoh, Kanagawa (JP); Akira Suzuki, Tokyo (JP); Shinichi Namekata, Kanagawa (JP); Kazuya Saito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 13/747,906

(22) Filed: Jan. 23, 2013

(65) Prior Publication Data

US 2013/0209119 A1 Aug. 15, 2013

(30) Foreign Application Priority Data

Feb. 9, 2012 (JP) ..... 2012-026647

(51) Int. Cl.
*G03G 15/20* (2006.01)

(52) U.S. Cl.
CPC ..... *G03G 15/2064* (2013.01); *G03G 15/205* (2013.01); *G03G 2215/2035* (2013.01)
USPC ..... 399/70

(58) Field of Classification Search
CPC ..... G03G 15/2046
USPC ..... 399/69–70
See application file for complete search history.

(56) References Cited

U.S. PATENT DOCUMENTS

| | | | | |
|---|---|---|---|---|
| 6,937,827 | B2 * | 8/2005 | Katoh et al. | 399/68 |
| 7,751,769 | B2 * | 7/2010 | Ishida et al. | 399/329 |
| 7,995,236 | B2 * | 8/2011 | Hoshi et al. | 358/1.5 |
| 2006/0029411 | A1 | 2/2006 | Ishii et al. | |
| 2007/0212089 | A1 | 9/2007 | Seo et al. | |
| 2007/0242988 | A1 | 10/2007 | Seo et al. | |
| 2007/0280754 | A1 | 12/2007 | Ogawa et al. | |
| 2007/0292175 | A1 | 12/2007 | Shinshi | |
| 2008/0025772 | A1 | 1/2008 | Seo et al. | |
| 2008/0025773 | A1 | 1/2008 | Ito et al. | |
| 2008/0219721 | A1 | 9/2008 | Ito et al. | |
| 2008/0226326 | A1 | 9/2008 | Seo et al. | |
| 2008/0232873 | A1 | 9/2008 | Ueno et al. | |
| 2009/0123201 | A1 | 5/2009 | Ehara et al. | |
| 2009/0148205 | A1 | 6/2009 | Seo et al. | |
| 2009/0245865 | A1 | 10/2009 | Shinshi et al. | |
| 2009/0245897 | A1 | 10/2009 | Seo et al. | |
| 2009/0297197 | A1 | 12/2009 | Hase | |
| 2010/0061753 | A1 | 3/2010 | Hase | |
| 2010/0074667 | A1 | 3/2010 | Ehara et al. | |
| 2010/0092220 | A1 | 4/2010 | Hasegawa et al. | |
| 2010/0092221 | A1 | 4/2010 | Shinshi et al. | |

2010/0202809 A1 8/2010 Shinshi et al.
2010/0290822 A1 11/2010 Hasegawa et al.
2010/0303521 A1 12/2010 Ogawa et al.
2011/0020018 A1 1/2011 Takenaka et al.
2011/0026988 A1 2/2011 Yoshikawa et al.
2011/0044706 A1 2/2011 Iwaya et al.
2011/0044734 A1 2/2011 Shimokawa et al.
2011/0052237 A1 3/2011 Yoshikawa et al.
2011/0052245 A1 3/2011 Shinshi et al.
2011/0052277 A1 3/2011 Ueno et al.
2011/0052282 A1 3/2011 Shinshi et al.
2011/0058862 A1 3/2011 Yamaguchi et al.
2011/0058863 A1 3/2011 Shinshi et al.
2011/0058864 A1 3/2011 Fujimoto et al.
2011/0058865 A1 3/2011 Tokuda et al.
2011/0058866 A1 3/2011 Ishii et al.
2011/0064437 A1 3/2011 Yamashina et al.
2011/0064443 A1 3/2011 Iwaya et al.
2011/0064450 A1 3/2011 Ishii et al.
2011/0064490 A1 3/2011 Imada et al.
2011/0064502 A1 3/2011 Hase et al.
2011/0076071 A1 3/2011 Yamaguchi et al.
2011/0085815 A1 4/2011 Kishi et al.
2011/0085832 A1 4/2011 Hasegawa et al.
2011/0091253 A1 4/2011 Seo et al.
2011/0116848 A1 5/2011 Yamaguchi et al.
2011/0129268 A1 6/2011 Ishii et al.
2011/0150518 A1 6/2011 Hase et al.
2011/0170917 A1 7/2011 Yoshikawa et al.
2011/0176821 A1 7/2011 Hase
2011/0176822 A1 7/2011 Ishii et al.
2011/0182634 A1 7/2011 Ishigaya et al.
2011/0182638 A1 7/2011 Ishii et al.
2011/0194870 A1 8/2011 Hase et al.
2011/0200368 A1 8/2011 Yamaguchi et al.
2011/0200370 A1 8/2011 Ikebuchi et al.
2011/0206427 A1 8/2011 Iwaya et al.
2011/0211876 A1 9/2011 Iwaya et al.
2011/0217056 A1 9/2011 Yoshinaga et al.
2011/0217057 A1 9/2011 Yoshinaga et al.
2011/0217093 A1 9/2011 Tokuda et al.
2011/0217095 A1 9/2011 Ishii et al.
2011/0222875 A1 9/2011 Imada et al.
2011/0222876 A1 9/2011 Yuasa et al.
2011/0222888 A1 9/2011 Ikebuchi et al.
2011/0222929 A1 9/2011 Fujimoto et al.
2011/0222930 A1 9/2011 Fujimoto et al.
2011/0222931 A1 9/2011 Shinshi et al.
2011/0229162 A1 9/2011 Ogawa et al.
2011/0229178 A1 9/2011 Ogawa et al.
2011/0229181 A1 9/2011 Iwaya et al.
2011/0229200 A1 9/2011 Yamaguchi et al.
2011/0229225 A1 9/2011 Ishii et al.
2011/0229226 A1 9/2011 Tokuda et al.
2011/0229227 A1 9/2011 Yoshikawa et al.
2011/0229228 A1 9/2011 Yoshikawa et al.
2011/0229236 A1 9/2011 Ehara et al.
2011/0274453 A1 11/2011 Shimokawa et al.
2011/0286758 A1 11/2011 Yoshinaga
2011/0293309 A1 12/2011 Hase
2011/0311284 A1 12/2011 Seo et al.
2012/0045226 A1 2/2012 Hase et al.
2012/0051766 A1 3/2012 Ueno et al.
2012/0051774 A1 3/2012 Ikebuchi et al.
2012/0093531 A1 4/2012 Yuasa et al.
2012/0093551 A1 4/2012 Ogawa et al.
2012/0107005 A1 5/2012 Hase et al.
2012/0114345 A1 5/2012 Fujimoto et al.
2012/0114354 A1 5/2012 Saito et al.
2012/0121303 A1 5/2012 Takagi et al.
2012/0121304 A1 5/2012 Tokuda et al.
2012/0121305 A1 5/2012 Yoshikawa et al.
2012/0148303 A1 6/2012 Yamaguchi et al.
2012/0155935 A1 6/2012 Yoshikawa et al.
2012/0155936 A1 6/2012 Yamaguchi et al.
2012/0177388 A1 7/2012 Imada et al.
2012/0177393 A1 7/2012 Ikebuchi et al.
2012/0177420 A1 7/2012 Shimokawa et al.
2012/0177423 A1 7/2012 Imada et al.
2012/0177424 A1 7/2012 Saito et al.
2012/0207523 A1 8/2012 Ueno et al.
2012/0219312 A1 8/2012 Yuasa et al.
2012/0224878 A1 9/2012 Ikebuchi et al.
2012/0237273 A1 9/2012 Yoshinaga et al.

FOREIGN PATENT DOCUMENTS

JP 7-248695 9/1995
JP 2006-010943 1/2006
JP 2006-072236 3/2006
JP 2007-233011 9/2007
JP 2007-334205 12/2007
JP 2011-028037 2/2011
JP 2011-164234 8/2011

OTHER PUBLICATIONS

U.S. Appl. No. 13/557,841, filed Jul. 25, 2012, Toshihiko Shimokawa, et al.

* cited by examiner

*Primary Examiner* — Clayton E Laballe
*Assistant Examiner* — Leon W Rhodes, Jr.
(74) *Attorney, Agent, or Firm* — Oblon, Spivak, McClelland, Maier & Neustadt, L.L.P.

(57) ABSTRACT

A fixing device includes a controller connected to a heater and at least one of a pressing rotary body and an endless rotary body. The controller performs a first fixing operation, a first transition operation, a second fixing operation, and a second transition operation. The first fixing operation fixes a toner image on a first recording medium after the fixing device is powered on. The first transition operation rotates the pressing rotary body and the endless rotary body while controlling the heater to maintain the endless rotary body at a predetermined temperature for a first duration time. The second fixing operation fixes a toner image on a second recording medium. The second transition operation rotates the pressing rotary body and the endless rotary body while controlling the heater to maintain the endless rotary body at the predetermined temperature for a second duration time smaller than the first duration time.

20 Claims, 8 Drawing Sheets

FIXING DEVICE, IMAGE FORMING APPARATUS INCORPORATING SAME, AND FIXING METHOD

CROSS-REFERENCE TO RELATED APPLICATION

This patent application is based on and claims priority pursuant to 35 U.S.C. §119 to Japanese Patent Application No. 2012-026647, filed on Feb. 9, 2012, in the Japanese Patent Office, the entire disclosure of which is hereby incorporated by reference herein.

BACKGROUND OF THE INVENTION

1. Field of the Invention

Exemplary aspects of the present invention relate to a fixing device, an image forming apparatus, and a fixing method, and more particularly, to a fixing device for fixing a toner image on a recording medium, an image forming apparatus incorporating the fixing device, and a fixing method performed by the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a development device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device is requested to shorten a first print time taken to output the recording medium bearing the toner image onto the outside of the image forming apparatus after the image forming apparatus receives a print job. Additionally, the fixing device is requested to generate a sufficient amount of heat even when a plurality of recording media is conveyed through the fixing device continuously at increased speed for high speed printing.

To address these requests, the fixing device may employ a thin endless belt having a decreased thermal capacity and therefore heated quickly by a heater. FIG. 1 illustrates such fixing device 100R1 that incorporates a thin endless belt 901. For example, as shown in FIG. 1, a pressing roller 904 is pressed against a substantially tubular, metal thermal conductor 902 disposed inside a loop formed by the endless belt 901 to form a fixing nip N between the pressing roller 904 and the endless belt 901. A heater 903 disposed inside the metal thermal conductor 902 heats the endless belt 901 via the metal thermal conductor 902. As the pressing roller 904 and the endless belt 901 rotate and convey a recording medium P bearing a toner image T through the fixing nip N, the endless belt 901 and the pressing roller 904 apply heat and pressure to the recording medium P, thus fixing the toner image T on the recording medium P. Since the heater 903 heats the endless belt 901 via the metal thermal conductor 902 that faces the entire inner circumferential surface of the endless belt 901, the endless belt 901 is heated to a predetermined fixing temperature quickly, thus meeting the above-described requests of shortening the first print time and generating heat sufficiently.

However, in order to shorten the first print time further and save more energy, the fixing device 100R1 is requested to heat the endless belt 901 more efficiently. To address this request, a configuration to heat the endless belt 901 directly, not via the metal thermal conductor 902, is proposed as shown in FIG. 2.

FIG. 2 illustrates a fixing device 100R2 in which the heater 903 heats the endless belt 901 directly. Instead of the metal thermal conductor 902 depicted in FIG. 1, a nip formation plate 905 is disposed inside the loop formed by the endless belt 901 and presses against the pressing roller 904 via the endless belt 901 to form the fixing nip N between the endless belt 901 and the pressing roller 904. Since the nip formation plate 905 does not encircle the heater 903 unlike the metal thermal conductor 902 depicted in FIG. 1, the heater 903 heats the endless belt 901 directly, thus improving heating efficiency for heating the endless belt 901 and thereby shortening the first print time further and saving more energy.

However, the fixing device 100R2 in which the heater 903 heats the endless belt 901 directly may cause cold offset due to a decreased temperature of the endless belt 901 that is too low to soften toner particles of the toner image T on the recording medium P. Accordingly, a part of the toner particles may peel off the recording medium P, resulting in fixing failure.

For example, when the fixing device 100R2 finishes a first print job performed after the fixing device 100R2 is powered on, the fixing device 100R2 may enter a sleep mode in which the heater 903 is turned off or a standby mode in which the heater 903 maintains the endless belt 901 at a standby temperature lower than a fixing temperature at which the toner image T is fixed on the recording medium P. Prior to the first print job, the fixing device 100R2 is warmed up for a substantial time so that the endless belt 901, the pressing roller 904, and the nip formation plate 905 are heated to the predetermined fixing temperature. Hence, the nip formation plate 905 stores a sufficient amount of heat during the first print job and therefore does not draw heat from the endless belt 901, preventing cold offset.

Conversely, prior to a second print job subsequent to the sleep mode or the standby mode, the fixing device 100R2 is warmed up for a shortened time because the components surrounding the endless belt 901 that are already heated during the first print job do not draw heat from the endless belt 901 and therefore the endless belt 901 is heated to the predetermined fixing temperature quickly. Accordingly, the nip formation plate 905 may not store a sufficient amount of heat within the shortened warm-up time prior to the second print job and thereby may draw heat from the endless belt 901 during the second print job, thus decreasing the temperature of the endless belt 901, which may cause cold offset.

SUMMARY OF THE INVENTION

This specification describes below an improved fixing device. In one exemplary embodiment of the present invention, the fixing device includes a pressing rotary body, a hollow, endless rotary body, a heater, a nip formation assembly, and a controller. The pressing rotary body is rotatable in a predetermined direction of rotation. The endless rotary body is in contact with the pressing rotary body and rotatable in a direction counter to the direction of rotation of the pressing rotary body. The heater is disposed opposite and heats the endless rotary body. The nip formation assembly is disposed opposite an inner circumferential surface of the endless rotary body and presses against the pressing rotary body via the endless rotary body to form a fixing nip between the endless rotary body and the pressing rotary body where first and second recording media bearing a toner image pass and receive heat and pressure from the endless rotary body and the pressing rotary body that fix the toner image on the first and second recording media. The controller is operatively connected to the heater and at least one of the pressing rotary body and the endless rotary body to perform a first fixing operation, a first transition operation, a second fixing operation, and a second transition operation. In the first fixing operation, the controller fixes the toner image on the first recording medium after the fixing device is powered on. In the first transition operation subsequent to the first fixing operation, the controller rotates the pressing rotary body and the endless rotary body while controlling the heater to maintain the endless rotary body at a predetermined temperature. In the second fixing operation subsequent to the first transition operation, the controller fixes the toner image on the second recording medium. In the second transition operation subsequent to the second fixing operation, the controller rotates the pressing rotary body and the endless rotary body while controlling the heater to maintain the endless rotary body at the predetermined temperature. The controller sets a first duration time for which the first transition operation is performed to be greater than a second duration time for which the second transition operation is performed.

This specification further describes an improved image forming apparatus. In one exemplary embodiment of the present invention, the image forming apparatus includes the fixing device described above.

This specification further describes an improved fixing method performed by a fixing device including an endless rotary body and a pressing rotary body pressed against the endless rotary body. In one exemplary embodiment of the present invention, the fixing method includes the steps of powering on the fixing device; rotating the pressing rotary body and the endless rotary body; heating the endless rotary body to a predetermined temperature; performing a first fixing operation for conveying a first recording medium bearing a toner image between the endless rotary body and the pressing rotary body; performing a first transition operation for rotating the pressing rotary body and the endless rotary body while maintaining the endless rotary body at the predetermined temperature for a first duration time; performing a second fixing operation for conveying a second recording medium bearing a toner image between the endless rotary body and the pressing rotary body; and performing a second transition operation for rotating the pressing rotary body and the endless rotary body while maintaining the endless rotary body at the predetermined temperature for a second duration time smaller than the first duration time.

BRIEF DESCRIPTION OF THE SEVERAL VIEWS OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
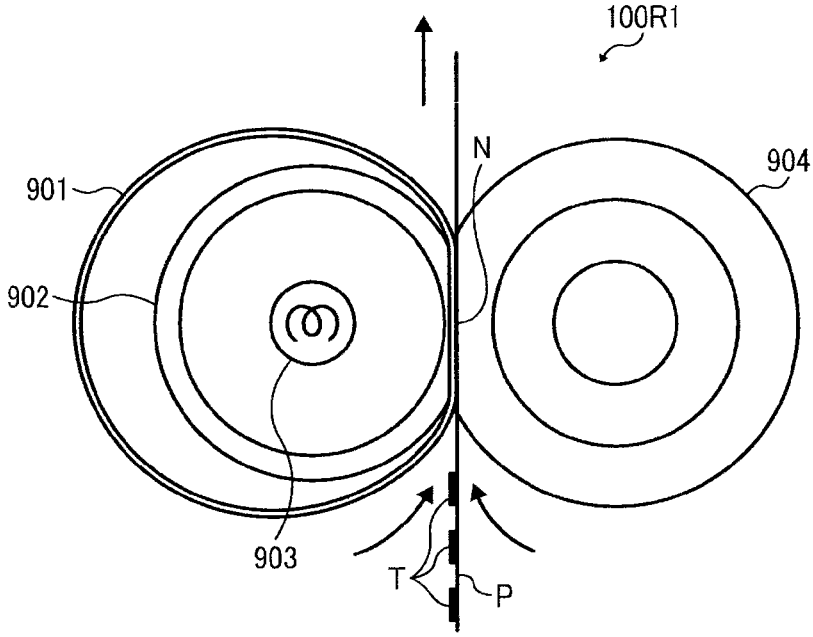
FIG. 1 RELATED ART
FIG. 1 is a schematic vertical sectional view of a related-art fixing device.
Figure 2:
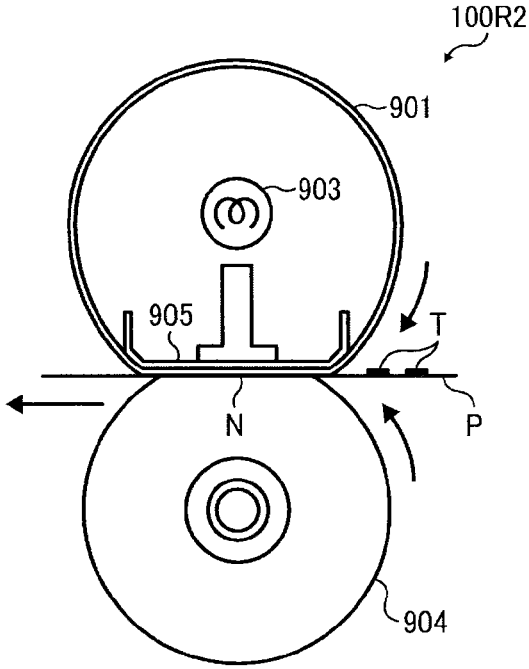
FIG. 2 RELATED ART
FIG. 2 is a schematic vertical sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Figure 3:
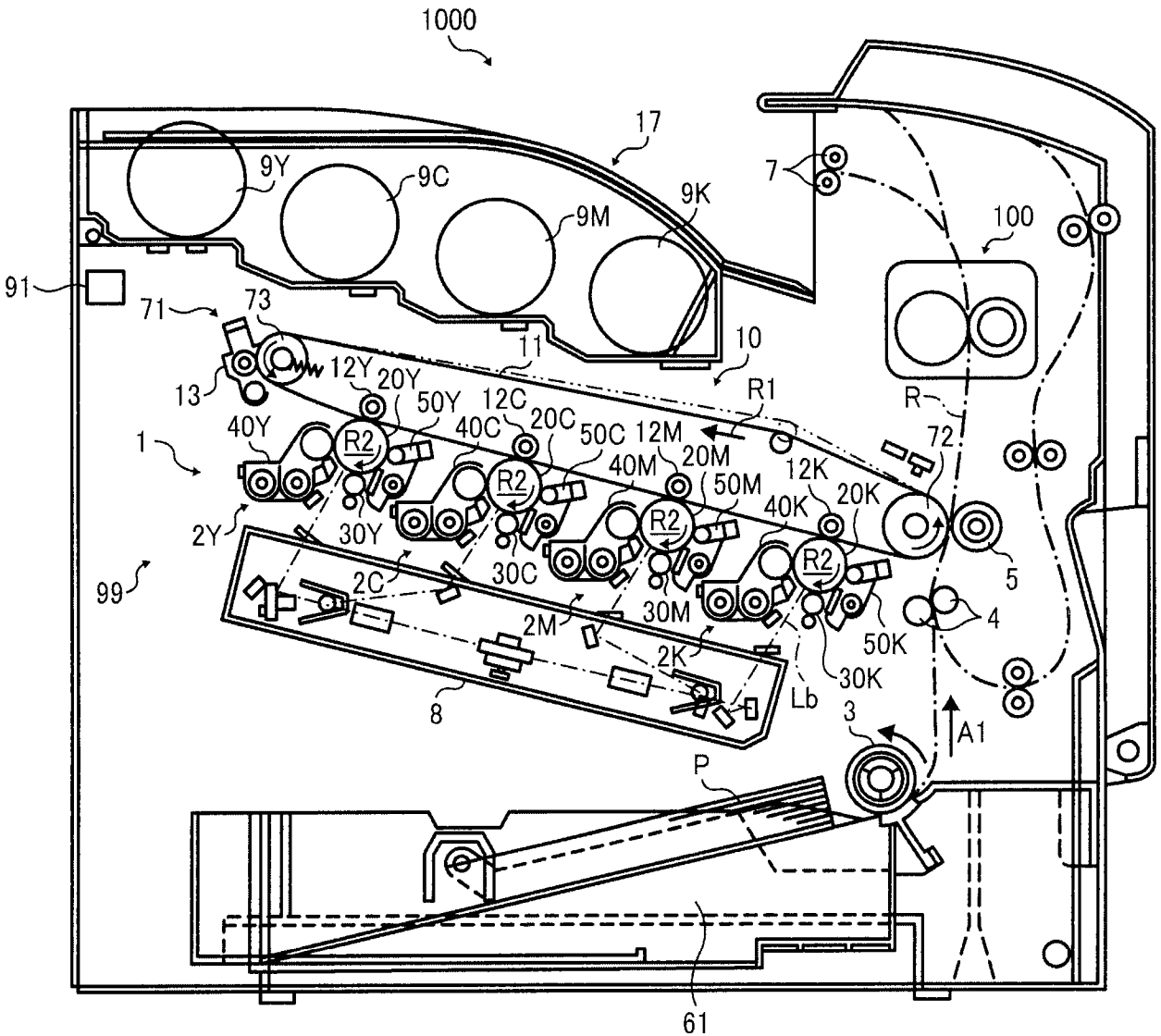
FIG. 3 is a schematic vertical sectional view of an image forming apparatus according to an exemplary embodiment of the present invention.

Referring now to the drawings, wherein like reference numerals designate identical or corresponding parts throughout the several views, in particular to FIG. 3, an image forming apparatus 1000 according to an exemplary embodiment of the present invention is explained.

FIG. 3 is a schematic vertical sectional view of the image forming apparatus 1000. The image forming apparatus 1000 may be a copier, a facsimile machine, a printer, a multifunction printer (MFP) having at least one of copying, printing, scanning, plotter, and facsimile functions, or the like. According to this exemplary embodiment, the image forming apparatus 1000 is a tandem color laser printer that forms color and monochrome toner images on recording media P by electrophotography.

As shown in FIG. 3, the image forming apparatus 1000 includes an image forming device 99 constructed of an optical writer 8, an image forming station 1, and a transfer device 71. The image forming station 1 is situated at a center portion of the image forming apparatus 1000 and incorporates four image forming units 2Y, 2C, 2M, and 2K that form yellow, cyan, magenta, and black toner images, respectively. The image forming units 2Y, 2C, 2M, and 2K are aligned along a rotation direction R1 of an endless intermediate transfer belt 11 serving as an intermediate transferor. Although the image forming units 2Y, 2C, 2M, and 2K contain yellow, cyan, magenta, and black developers (e.g., toners) that form yellow, cyan, magenta, and black toner images, respectively, resulting in a color toner image, they have an identical structure.

The image forming units 2Y, 2C, 2M, and 2K include photoconductive drums 20Y, 20C, 20M, and 20K aligned in the rotation direction R1 of the intermediate transfer belt 11 and serving as a plurality of image carriers that carries the yellow, cyan, magenta, and black toner images, respectively. The visible yellow, cyan, magenta, and black toner images formed on the photoconductive drums 20Y, 20C, 20M, and 20K are primarily transferred onto the intermediate transfer belt 11 that rotates in the rotation direction R1 as it slides over the photoconductive drums 20Y, 20C, 20M, and 20K in a primary transfer process in such a manner that the yellow, cyan, magenta, and black toner images are superimposed on a same position on the intermediate transfer belt 11. Thereafter, the yellow, cyan, magenta, and black toner images superimposed on the intermediate transfer belt 11 are secondarily transferred onto a recording medium P (e.g., a sheet) collectively in a secondary transfer process.

The photoconductive drums 20Y, 20C, 20M, and 20K are surrounded by various devices used to form the yellow, cyan, magenta, and black toner images on the photoconductive drums 20Y, 20C, 20M, and 20K rotating clockwise in FIG. 3 in a rotation direction R2. Taking the photoconductive drum 20K used to form a black toner image as an example, the photoconductive drum 20K is surrounded by a charger 30K, a development device 40K, a primary transfer roller 12K serving as a primary transferor, and a cleaner 50K, which are arranged in the rotation direction R2 of the photoconductive drum 20K. After the charger 30K charges an outer circumferential surface of the photoconductive drum 20K, the optical writer 8, serving as an exposure device, exposes the charged outer circumferential surface of the photoconductive drum 20K, writing an electrostatic latent image on the photoconductive drum 20K.

For example, the optical writer 8 is constructed of a semiconductor laser serving as a light source, a coupling lens, an f-θ lens, a troidal lens, reflection mirrors, and a rotatable polygon mirror serving as an optical deflector. The optical writer 8 emits laser beams Lb onto the outer circumferential surface of the respective photoconductive drums 20Y, 20C, 20M, and 20K according to image data sent from an external device such as a client computer, thus forming electrostatic latent images on the photoconductive drums 20Y, 20C, 20M, and 20K, respectively.

As the intermediate transfer belt 11 rotates in the rotation direction R1, the yellow, cyan, magenta, and black toner images formed on the photoconductive drums 20Y, 20C, 20M, and 20K are primarily transferred onto the intermediate transfer belt 11 in such a manner that the yellow, cyan, magenta, and black toner images are superimposed on the same position on the intermediate transfer belt 11. For example, the photoconductive drums 20Y, 20C, 20M, and 20K are disposed opposite primary transfer rollers 12Y, 12C, 12M, and 12K serving as primary transferors, respectively, via the intermediate transfer belt 11. As a primary transfer bias is applied to the primary transfer rollers 12Y, 12C, 12M, and 12K, the yellow, cyan, magenta, and black toner images formed on the photoconductive drums 20Y, 20C, 20M, and 20K are primarily transferred onto the intermediate transfer belt 11 successively at different times from the upstream photoconductive drum 20Y to the downstream photoconductive drum 20K in the rotation direction R1 of the intermediate transfer belt 11.

The primary transfer rollers 12Y, 12C, 12M, and 12K sandwich the intermediate transfer belt 11 together with the photoconductive drums 20Y, 20C, 20M, and 20K, forming primary transfer nips between the intermediate transfer belt 11 and the photoconductive drums 20Y, 20C, 20M, and 20K. A power supply connected to the primary transfer rollers 12Y, 12C, 12M, and 12K applies a primary transfer bias, that is, a predetermined direct current voltage and/or an alternating current voltage, to the primary transfer rollers 12Y, 12C, 12M, and 12K.

The photoconductive drums 20Y, 20C, 20M, and 20K are aligned in this order in the rotation direction R1 of the intermediate transfer belt 11. As described above, the four photoconductive drums 20Y, 20C, 20M, and 20K are incorporated in the four image forming units 2Y, 2C, 2M, and 2K that form yellow, cyan, magenta, and black toner images, respectively.

Above the photoconductive drums 20Y, 20C, 20M, and 20K are a transfer belt unit 10, a secondary transfer roller 5 serving as a secondary transferor, and a transfer belt cleaner 13. Below the photoconductive drums 20Y, 20C, 20M, and 20K is the optical writer 8 described above.

In addition to the endless intermediate transfer belt 11 and the plurality of primary transfer rollers 12Y, 12C, 12M, and 12K, the transfer belt unit 10 further includes a driving roller 72 and a driven roller 73 that support the intermediate transfer belt 11 looped thereover. As a driver drives and rotates the driving roller 72 counterclockwise in FIG. 3, the driving roller 72 rotates the intermediate transfer belt 11 in the rotation direction R1 by friction therebetween. The driving roller 72 also serves as a secondary transfer backup roller disposed opposite the secondary transfer roller 5 via the intermediate transfer belt 11. Similarly, the driven roller 73 also serves as a cleaning backup roller disposed opposite the belt cleaner 13 via the intermediate transfer belt 11. The driven roller 73 is attached with a biasing member such as a spring that presses the driven roller 73 against the belt cleaner 13 via the intermediate transfer belt 11. Thus, the driven roller 73 also stretches the intermediate transfer belt 11. The transfer belt unit 10, the primary transfer rollers 12Y, 12C, 12M, and 12K, the secondary transfer roller 5, and the belt cleaner 13 constitute the transfer device 71.

The secondary transfer roller 5 contacting the intermediate transfer belt 11 rotates in accordance with rotation of the intermediate transfer belt 11. The secondary transfer roller 5 sandwiches the intermediate transfer belt 11 together with the driving roller 72 to form a secondary transfer nip between the secondary transfer roller 5 and the intermediate transfer belt 11. Similar to the primary transfer rollers 12Y, 12C, 12M, and 12K, the secondary transfer roller 5 is connected to the power supply that applies a secondary transfer bias, that is, a predetermined direct current voltage and/or alternating current voltage thereto.

The belt cleaner 13 is disposed opposite the driven roller 73 via the intermediate transfer belt 11 and cleans an outer circumferential surface of the intermediate transfer belt 11. The belt cleaner 13 includes a cleaning brush and a cleaning blade that contact the outer circumferential surface of the intermediate transfer belt 11. A waste toner conveyance tube extending from the belt cleaner 13 to an inlet of a waste toner container conveys waste toner collected from the intermediate transfer belt 11 by the belt cleaner 13 to the waste toner container.

Below or beside the optical writer 8 are a paper tray 61, a registration roller pair 4, and a recording medium sensor. The paper tray 61 loads a plurality of recording media P. The registration roller pair 4 feeds a recording medium P sent from the paper tray 61 to the secondary transfer nip. The recording medium sensor detects a leading edge of the recording medium P. For example, the paper tray 61 is situated in a lower portion of the image forming apparatus 1000 and is attached with a feed roller 3 that picks up and feeds an uppermost recording medium P of the plurality of recording media P loaded in the paper tray 61. As the feed roller 3 is driven and rotated counterclockwise in FIG. 3, the feed roller 3 feeds the uppermost recording medium P to the registration roller pair 4.

A conveyance path R extends from the feed roller 3 to an output roller pair 7 to convey the recording medium P picked up from the paper tray 61 onto an outside of the image forming apparatus 1000 through the secondary transfer nip. The conveyance path R is provided with the registration roller pair 4 situated upstream from the secondary transfer nip formed between the secondary transfer roller 5 and the intermediate transfer belt 11 in a recording medium conveyance direction A1 to feed the recording medium P to the secondary transfer nip. For example, the registration roller pair 4 feeds the recording medium P conveyed from the paper tray 61 to the secondary transfer nip at a proper time when the color toner image formed on the intermediate transfer belt 11 by the image forming station 1 as described above reaches the secondary transfer nip. The recording medium sensor detects the leading edge of the recording medium P when it reaches the registration roller pair 4.

The recording media P may be thick paper, postcards, envelopes, plain paper, thin paper, coated paper, art paper, tracing paper, OHP (overhead projector) transparencies, recording sheets, and the like. In addition to the paper tray 61, the image forming apparatus 1000 may be equipped with a bypass tray that loads thick paper, postcards, envelopes, thin paper, tracing paper, OHP transparencies, and the like.

Downstream from the secondary transfer nip in the recording medium conveyance direction A1 are a fixing device 100, the output roller pair 7, and an output tray 17. The fixing device 100 fixes the color toner image transferred from the intermediate transfer belt 11 onto the recording medium P thereon. The output roller pair 7 discharges the recording medium P bearing the fixed color toner image onto the outside of the image forming apparatus 1000, that is, the output tray 17. The output tray 17, disposed atop the image forming apparatus 1000, stocks the recording medium P discharged by the output roller pair 7.

A plurality of toner bottles 9Y, 9C, 9M, and 9K containing fresh yellow, cyan, magenta, and black toners is detachably attached to a plurality of toner bottle holders, respectively, disposed in an upper portion of the image forming apparatus 1000 situated below the output tray 17. A toner supply tube is interposed between the toner bottles 9Y, 9C, 9M, and 9K and the development devices 40Y, 40C, 40M, and 40K, respectively, thus supplying the fresh yellow, cyan, magenta, and black toners from the toner bottles 9Y, 9C, 9M, and 9K to the development devices 40Y, 40C, 40M, and 40K.

As described above, the belt cleaner 13 of the transfer device 71 includes the cleaning brush and the cleaning blade that contact the outer circumferential surface of the intermediate transfer belt 11. The cleaning brush and the cleaning blade scrape and remove a foreign substance such as residual toner off the intermediate transfer belt 11, thus cleaning the intermediate transfer belt 11. The belt cleaner 13 includes a waste toner discharger that discharges the residual toner collected from the intermediate transfer belt 11 into the waste toner conveyance tube described above.

With reference to FIG. 3, a description is provided of an image forming operation performed by the image forming apparatus 1000 having the structure described above to form a color toner image on a recording medium P.

As a print job starts, a driver drives and rotates the photoconductive drums 20Y, 20C, 20M, and 20K of the image forming units 2Y, 2C, 2M, and 2K, respectively, clockwise in FIG. 3 in the rotation direction R2. The chargers 30Y, 30C, 30M, and 30K uniformly charge the outer circumferential surface of the respective photoconductive drums 20Y, 20C, 20M, and 20K at a predetermined polarity. The optical writer 8 emits laser beams Lb onto the charged outer circumferential surface of the respective photoconductive drums 20Y, 20C, 20M, and 20K according to yellow, cyan, magenta, and black image data contained in image data sent from the external device, respectively, thus forming electrostatic latent images thereon. The development devices 40Y, 40C, 40M, and 40K supply yellow, cyan, magenta, and black toners to the electrostatic latent images formed on the photoconductive drums 20Y, 20C, 20M, and 20K, visualizing the electrostatic latent images into yellow, cyan, magenta, and black toner images, respectively.

Simultaneously, as the print job starts, the driving roller 72 is driven and rotated counterclockwise in FIG. 3, rotating the intermediate transfer belt 11 in the rotation direction R1 by friction therebetween. A power supply applies a constant voltage or a constant current control voltage having a polarity opposite a polarity of the toner to the primary transfer rollers 12Y, 12C, 12M, and 12K. Thus, a predetermined transfer electric field is created at the primary transfer nips formed between the primary transfer rollers 12Y, 12C, 12M, and 12K and the photoconductive drums 20Y, 20C, 20M, and 20K, respectively.

When the yellow, cyan, magenta, and black toner images formed on the photoconductive drums 20Y, 20C, 20M, and 20K reach the primary transfer nips, respectively, in accordance with rotation of the photoconductive drums 20Y, 20C, 20M, and 20K, the yellow, cyan, magenta, and black toner images are primarily transferred from the photoconductive drums 20Y, 20C, 20M, and 20K onto the intermediate transfer belt 11 by the transfer electric field created at the primary transfer nips in such a manner that the yellow, cyan, magenta, and black toner images are superimposed successively on the same position on the intermediate transfer belt 11. Thus, a color toner image is formed on the intermediate transfer belt 11.

After the primary transfer of the yellow, cyan, magenta, and black toner images from the photoconductive drums 20Y, 20C, 20M, and 20K onto the intermediate transfer belt 11, the cleaners 50Y, 50C, 50M, and 50K remove residual toner failed to be transferred onto the intermediate transfer belt 11 and therefore remaining on the photoconductive drums 20Y, 20C, 20M, and 20K therefrom. Thereafter, dischargers discharge the outer circumferential surface of the respective photoconductive drums 20Y, 20C, 20M, and 20K, initializing the surface potential thereof.

On the other hand, the feed roller 3 disposed in the lower portion of the image forming apparatus 1000 is driven and rotated to feed a recording medium P from the paper tray 61 toward the registration roller pair 4 in the conveyance path R. The registration roller pair 4 feeds the recording medium P to the secondary transfer nip formed between the secondary transfer roller 5 and the intermediate transfer belt 11 at a time when the color toner image formed on the intermediate transfer belt 11 reaches the secondary transfer nip. The secondary transfer roller 5 is applied with a transfer voltage having a polarity opposite a polarity of the charged yellow, cyan, magenta, and black toners constituting the color toner image formed on the intermediate transfer belt 11, thus creating a predetermined transfer electric field at the secondary transfer nip.

When the color toner image formed on the intermediate transfer belt 11 reaches the secondary transfer nip in accordance with rotation of the intermediate transfer belt 11, the color toner image is secondarily transferred from the intermediate transfer belt 11 onto the recording medium P by the transfer electric field created at the secondary transfer nip. After the secondary transfer of the color toner image from the intermediate transfer belt 11 onto the recording medium P, the belt cleaner 13 removes residual toner failed to be transferred onto the recording medium P and therefore remaining on the intermediate transfer belt 11 therefrom. The removed toner is conveyed and collected into the waste toner container.

Thereafter, the recording medium P bearing the color toner image is conveyed to the fixing device 100 where the color toner image is fixed on the recording medium P. Then, the recording medium P bearing the fixed color toner image is discharged by the output roller pair 7 onto the output tray 17.

The above describes the image forming operation of the image forming apparatus 1000 to form the color toner image on the recording medium P. Alternatively, the image forming apparatus 1000 may form a monochrome toner image by using any one of the four image forming units 2Y, 2C, 2M, and 2K or may form a bicolor or tricolor toner image by using two or three of the image forming units 2Y, 2C, 2M, and 2K.

Figure 4:
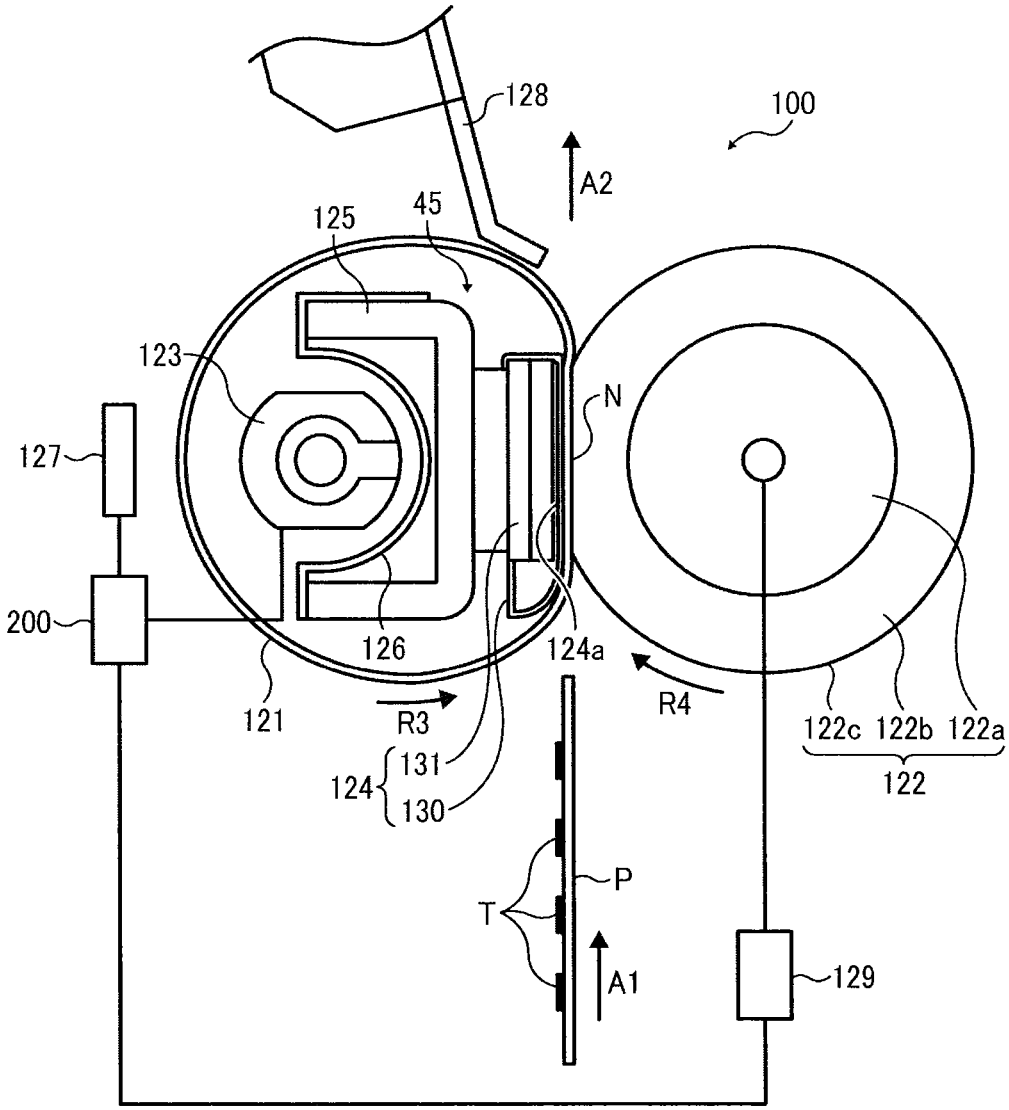
FIG. 4 is a vertical sectional view of a fixing device according to a first exemplary embodiment incorporated in the image forming apparatus shown in FIG. 3.

With reference to FIG. 4, a description is provided of a construction of the fixing device 100 incorporated in the image forming apparatus 1000 described above.

FIG. 4 is a schematic vertical sectional view of the fixing device 100 according to a first exemplary embodiment. As shown in FIG. 4, the fixing device 100 (e.g., a fuser) includes a fixing belt 121 serving as a heating rotary body or an endless rotary body formed into a loop and rotatable in a rotation direction R3; a pressing roller 122 serving as a pressing rotary body or an opposed rotary body disposed opposite an outer circumferential surface of the fixing belt 121 and rotatable in a rotation direction R4 counter to the rotation direction R3 of the fixing belt 121; a halogen heater 123 serving as a heater disposed inside the loop formed by the fixing belt 121 and heating the fixing belt 121; a nip formation assembly 124 disposed inside the loop formed by the fixing belt 121 and pressing against the pressing roller 122 via the fixing belt 121 to form a fixing nip N between the fixing belt 121 and the pressing roller 122; a stay 125 serving as a support disposed inside the loop formed by the fixing belt 121 and contacting and supporting the nip formation assembly 124; a reflector 126 disposed inside the loop formed by the fixing belt 121 and reflecting light radiated from the halogen heater 123 thereto toward the fixing belt 121; a temperature sensor 127 serving as a temperature detector disposed opposite the outer circumferential surface of the fixing belt 121 and detecting the temperature of the fixing belt 121; and a separator 128 disposed opposite the outer circumferential surface of the fixing belt 121 and separating the recording medium P from the fixing belt 121. The fixing device 100 further includes a pressurization assembly that presses the pressing roller 122 against the nip formation assembly 124 via the fixing belt 121.

The fixing belt 121 is heated directly by light radiated from the halogen heater 123 disposed opposite an inner circumferential surface of the fixing belt 121. The nip formation assembly 124 is disposed opposite the inner circumferential surface of the fixing belt 121. As the fixing belt 121 rotates in the rotation direction R3, the inner circumferential surface of the fixing belt 121 slides over the nip formation assembly 124.

As shown in FIG. 4, the nip formation assembly 124 has an opposed face 124*a* disposed opposite the fixing belt 121 at the fixing nip N and linearly extending in the recording medium conveyance direction A1 to produce the planar fixing nip N. Alternatively, the opposed face 124*a* of the nip formation assembly 124 may be concave with respect to the fixing belt 121 or have other shapes. If the concave opposed face 124*a* of the nip formation assembly 124 produces the concave fixing nip N, the concave fixing nip N directs a leading edge of a recording medium P toward the pressing roller 122 as the recording medium P is discharged from the fixing nip N, thus facilitating separation of the recording medium P from the fixing belt 121 and thereby minimizing jamming of the recording medium P.

A detailed description is now given of a construction of the fixing belt 121.

The fixing belt 121 is a thin, flexible endless belt or film. For example, the fixing belt 121 is constructed of a base layer constituting the inner circumferential surface of the fixing belt 121 and a release layer constituting the outer circumferential surface of the fixing belt 121. The base layer is made of metal such as nickel and SUS stainless steel or resin such as polyimide (PI). The release layer is made of tetrafluoroethylene-perfluoroalkylvinylether copolymer (PFA), polytetrafluoroethylene (PTFE), or the like. The release layer prevents adhesion of toner from the recording medium P to the fixing belt 121. Alternatively, an elastic layer, made of rubber such as silicone rubber, silicone rubber foam, and fluoro rubber, may be interposed between the base layer and the release layer. As the fixing belt 121 and the pressing roller 122 exert pressure to a toner image T on a recording medium P, the elastic layer of the fixing belt 121 prevents slight surface asperities of the fixing belt 121 from being transferred onto the toner image T on the recording medium P, thus minimizing variation in gloss of the solid toner image T, that is, minimizing formation of an orange peel image. It is preferable that the elastic layer of the fixing belt 121 has a thickness not smaller than about 100 micrometers, for example, to prevent formation of an orange peel image effectively. As the elastic layer of the fixing belt 121 is deformed by pressure between the pressing roller 122 and the fixing belt 121, the elastic layer absorbs slight surface asperities of the fixing belt 121, preventing formation of an orange peel image.

A detailed description is now given of a construction of the pressing roller 122.

The pressing roller 122 is constructed of a metal core 122*a*; an elastic layer 122*b* coating the metal core 122*a* and made of silicone rubber foam, silicone rubber, fluoro rubber, or the like; and a release layer 122*c* coating the elastic layer 122*b* and made of PFA, PTFE, or the like. The pressurization assembly including a spring presses the pressing roller 122 against the nip formation assembly 124 via the fixing belt 121. Thus, the pressing roller 122 pressingly contacting the fixing belt 121 deforms the elastic layer 122*b* of the pressing roller 122 at the fixing nip N formed between the pressing roller 122 and the fixing belt 121, thus creating the fixing nip N having a predetermined length in the recording medium conveyance direction A1.

A pressing roller driver 129 (e.g., a motor), disposed inside the image forming apparatus 1000 depicted in FIG. 3 and connected to the pressing roller 122 and a controller 200, drives and rotates the pressing roller 122 through a gear train.

The fixing belt 121 rotates in accordance with rotation of the pressing roller 122. For example, as described above, as the pressing roller driver 129 such as the motor drives and rotates the pressing roller 122 in the rotation direction R4, a driving force of the pressing roller driver 129 is transmitted from the pressing roller 122 to the fixing belt 121 at the fixing nip N, thus rotating the fixing belt 121 by friction between the pressing roller 122 and the fixing belt 121. At the fixing nip N, the fixing belt 121 is nipped between the pressing roller 122 and the nip formation assembly 124 and is rotated by friction with the pressing roller 122. Conversely, at a position other than the fixing nip N, the fixing belt 121 is rotated while guided by a belt holder 140 described below at each lateral end of the fixing belt 121 in an axial direction thereof.

Alternatively, the fixing belt 121 may not rotate in accordance with rotation of the pressing roller 122. For example, the fixing belt 121 may be rotated by a driver (e.g., a motor) connected thereto through a gear train that engages a gear mounted on a flange mounting the fixing belt 121.

According to this exemplary embodiment, the pressing roller 122 is a solid roller. Alternatively, the pressing roller 122 may be a hollow roller. In this case, a heater such as a halogen heater may be disposed inside the hollow roller. If the pressing roller 122 does not incorporate the elastic layer 122*b*, the pressing roller 122 has a decreased thermal capacity that improves fixing performance of being heated to a predetermined fixing temperature quickly. However, as the pressing roller 122 and the fixing belt 121 sandwich and press the toner image T on the recording medium P passing through the fixing nip N, slight surface asperities of the fixing belt 121 may be transferred onto the toner image T on the recording medium P, resulting in variation in gloss of the solid toner image T. To address this problem, it is preferable that the pressing roller 122 incorporates the elastic layer 122*b* having a thickness not smaller than about 100 micrometers. The elastic layer 122*b* having the thickness not smaller than about 100 micrometers elastically deforms to absorb slight surface asperities of the fixing belt 121, preventing variation in gloss of the toner image Ton the recording medium P.

The elastic layer 122*b* of the pressing roller 122 is made of solid rubber. Alternatively, if no heater is disposed inside the pressing roller 122, the elastic layer 122*b* may be made of insulative rubber, such as sponge rubber. The insulative rubber such as sponge rubber is more preferable than the solid rubber because it has an increased insulation that draws less heat from the fixing belt 121. According to this exemplary embodiment, the pressing roller 122 is pressed against the fixing belt 121. Alternatively, the pressing roller 122 may merely contact the fixing belt 121 with no pressure therebetween.

A detailed description is now given of a configuration of the halogen heater 123.

Both lateral ends of the halogen heater 123 in a longitudinal direction thereof parallel to the axial direction of the fixing belt 121 are mounted on side plates 142 described below of the fixing device 100, respectively. A power supply situated inside the image forming apparatus 1000 supplies power to the halogen heater 123 so that the halogen heater 123 heats the fixing belt 121. The controller 200, that is, a central processing unit (CPU), provided with a random-access memory (RAM) and a read-only memory (ROM), for example, operatively connected to the halogen heater 123 and the temperature sensor 127 controls the halogen heater 123, that is, turns on and off the halogen heater 123 or adjusts an amount of power supplied to the halogen heater 123 based on the temperature of the fixing belt 121 detected by the temperature sensor 127 so as to adjust the temperature of the fixing belt 121 to a desired fixing temperature. Alternatively, an induction heater, a resistance heat generator, a carbon heater, or the like may be employed as a heater that heats the fixing belt 121 instead of the halogen heater 123.

A detailed description is now given of a construction of the nip formation assembly 124.

The nip formation assembly 124 includes a base pad 131 and a slide sheet 130 (e.g., a low-friction sheet) covering an outer surface of the base pad 131. A longitudinal direction of the base pad 131 in which it extends is parallel to the axial direction of the fixing belt 121 or the pressing roller 122. The base pad 131 receives pressure from the pressing roller 122 to define the shape of the fixing nip N.

The base pad 131 of the nip formation assembly 124 is mounted on and supported by the stay 125. Thus, the nip formation assembly 124 and the stay 125 constitute a nip formation set 45. Accordingly, even if the base pad 131 receives pressure from the pressing roller 122, the base pad 131 is not bent by the pressure and therefore produces a uniform nip width throughout the entire width of the pressing roller 122 in the axial direction thereof.

The base pad 131 is made of a heat-resistant material having heat resistance against temperatures not lower than about 200 degrees centigrade. Accordingly, even if the base pad 131 is heated to a predetermined fixing temperature range, the base pad 131 is not thermally deformed, thus retaining the desired shape of the fixing nip N stably and thereby maintaining the quality of the fixed toner image T on the recording medium P. For example, the base pad 131 is made of general heat-resistant resin such as polyether sulfone (PES), polyphenylene sulfide (PPS), liquid crystal polymer (LCP), polyether nitrile (PEN), polyamide imide (PAI), polyether ether ketone (PEEK), or the like.

The slide sheet 130 is interposed at least between the base pad 131 and the fixing belt 121. For example, the slide sheet 130 covers at least the opposed face 124*a* of the base pad 131 disposed opposite the fixing belt 121 at the fixing nip N. As the fixing belt 121 rotates in the rotation direction R3, it slides over the low-frictional slide sheet 130, decreasing a driving torque exerted on the fixing belt 121. Accordingly, a decreased friction is imposed onto the fixing belt 121 from the nip formation assembly 124. According to this exemplary embodiment, the fixing belt 121 slides over the base pad 131 indirectly via the slide sheet 130. Alternatively, the nip formation assembly 124 may not incorporate the slide sheet 130 so that the fixing belt 121 slides over the base pad 131 directly.

The stay 125 is made of metal having an increased mechanical strength, such as stainless steel and iron, to support the nip formation assembly 124 against pressure from the pressing roller 122, thus preventing bending of the nip formation assembly 124. The base pad 131 is also made of a rigid material having an increased mechanical strength. For example, the base pad 131 is made of resin such as LCP, metal, ceramic, or the like.

A detailed description is now given of a configuration of the reflector 126.

The reflector 126 is interposed between the stay 125 and the halogen heater 123. According to this exemplary embodiment, the reflector 126 is mounted on the stay 125. For example, the reflector 126 is made of aluminum, stainless steel, or the like. The reflector 126 has a reflection face that reflects light, that is, radiation heat, radiated from the halogen heater 123 thereto toward the fixing belt 121. Accordingly, the fixing belt 121 receives an increased amount of light from the halogen heater 123 and thereby is heated efficiently. Instead of mounting the reflector 126, a surface of the stay 125 may be mirror finished to attain the advantages described above.

The fixing device 100 according to this exemplary embodiment attains various improvements to save more energy and shorten a first print time taken to output a recording medium P bearing a fixed toner image T onto the outside of the image forming apparatus 1000 depicted in FIG. 3 after the image forming apparatus 1000 receives a print job.

As a first improvement, the fixing device 100 employs a direct heating method in which the halogen heater 123 directly heats the fixing belt 121 at a portion thereof other than a nip portion thereof facing the fixing nip N. For example, as shown in FIG. 4, no component is interposed between the halogen heater 123 and the fixing belt 121 at an outward portion of the fixing belt 121 disposed opposite the temperature sensor 127. Accordingly, radiation heat from the halogen heater 123 is directly transmitted to the fixing belt 121 at the outward portion thereof.

As a second improvement, the fixing belt 121 is designed to be thin and have a reduced loop diameter so as to decrease the thermal capacity thereof. For example, the fixing belt 121 is constructed of the base layer having a thickness in a range of from about 20 micrometers to about 50 micrometers; the elastic layer having a thickness in a range of from about 100 micrometers to about 300 micrometers; and the release layer having a thickness in a range of from about 10 micrometers to about 50 micrometers. Thus, the fixing belt 121 has a total thickness not greater than about 1 mm. The loop diameter of the fixing belt 121 is in a range of from about 20 mm to about 40 mm. In order to decrease the thermal capacity of the fixing belt 121 further, the fixing belt 121 may have a total thickness not greater than about 0.20 mm, preferably not greater than about 0.16 mm. Additionally, the loop diameter of the fixing belt 121 may be not greater than about 30 mm.

According to this exemplary embodiment, the pressing roller 122 has a diameter in a range of from about 20 mm to about 40 mm so that the loop diameter of the fixing belt 121 is equivalent to the diameter of the pressing roller 122. However, the loop diameter of the fixing belt 121 and the diameter of the pressing roller 122 are not limited to the above. For example, the loop diameter of the fixing belt 121 may be smaller than the diameter of the pressing roller 122. In this case, the curvature of the fixing belt 121 at the fixing nip N is greater than that of the pressing roller 122, facilitating separation of the recording medium P discharged from the fixing nip N from the fixing belt 121.

Since the fixing belt 121 has a decreased loop diameter, space inside the loop formed by the fixing belt 121 is small. To address this circumstance, both ends of the stay 125 in the recording medium conveyance direction A1 are folded into a square bracket that accommodates the halogen heater 123. Thus, the stay 125 and the halogen heater 123 are placed in the small space inside the loop formed by the fixing belt 121.

Figure 5A:
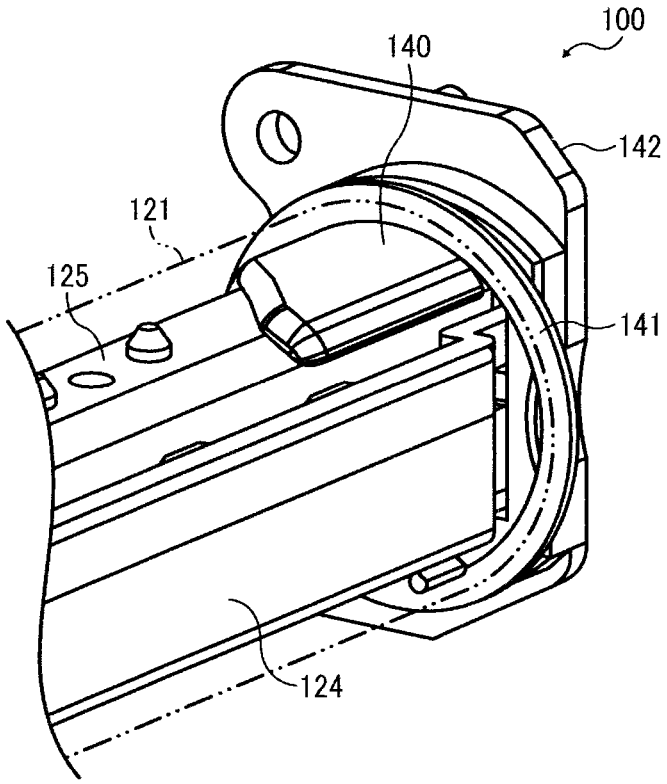
FIG. 5A is a partial perspective view of the fixing device shown in FIG. 4 illustrating one lateral end of a fixing belt incorporated therein in an axial direction thereof.
Figure 5B:
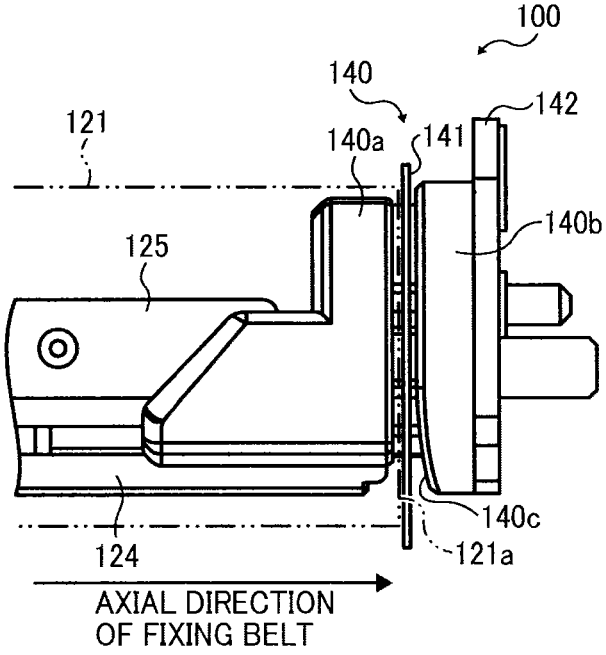
FIG. 5B is a partial plan view of the fixing device shown in FIG. 5A.
Figure 5C:
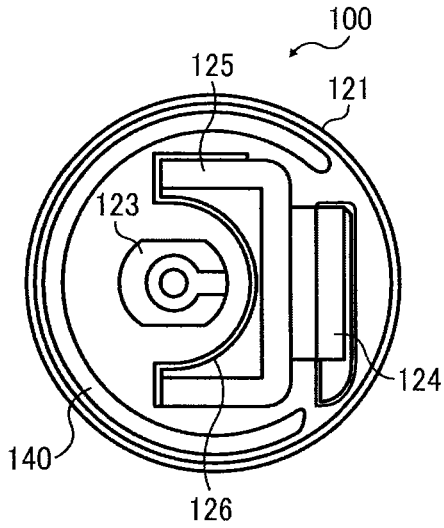
FIG. 5C is a vertical sectional view of the fixing device shown in FIG. 5A illustrating one lateral end of the fixing belt in the axial direction thereof.

With reference to FIGS. 5A, 5B, and 5C, a description is provided of a configuration of a lateral end of the fixing belt 121 in the axial direction thereof.

FIG. 5A is a perspective view of one lateral end of the fixing belt 121 in the axial direction thereof. FIG. 5B is a plan view of one lateral end of the fixing belt 121 in the axial direction thereof parallel to a width direction of a recording medium P. FIG. 5C is a vertical sectional view of one lateral end of the fixing belt 121 in the axial direction thereof. Although not shown, another lateral end of the fixing belt 121 in the axial direction thereof has the identical configuration shown in FIGS. 5A to 5C. Hence, the following describes the configuration of one lateral end of the fixing belt 121 in the axial direction thereof with reference to FIGS. 5A to 5C.

As shown in FIGS. 5A and 5B, the belt holder 140 is inserted into the loop formed by the fixing belt 121 at each lateral end of the fixing belt 121 in the axial direction thereof orthogonal to a circumferential direction thereof to rotatably support the fixing belt 121. As shown in FIG. 5C, the belt holder 140 is a flange that is C-shaped in cross-section to create an opening disposed opposite the fixing nip N where the nip formation assembly 124 is situated. As shown in FIG. 5A, the belt holder 140 is mounted on the side plate 142. Each lateral end of the stay 125 in a longitudinal direction thereof is also mounted on and positioned by the side plate 142. Like the stay 125, the side plate 142 is made of metal such as stainless steel and iron. Since the side plate 142 and the stay 125 are made of the common material, the stay 125 is mounted on the side plate 142 precisely.

As shown in FIG. 5B, the belt holder 140 is constructed of a tube 140*a* and a flange 140*b* disposed outboard from the tube 140*a* in the axial direction of the fixing belt 121. A slip ring 141 is interposed between a lateral edge 121*a* of the fixing belt 121 and an inward face 140*c* of the flange 140*b* of the belt holder 140 disposed opposite the lateral edge 121*a* of the fixing belt 121 in the axial direction thereof. The slip ring 141 serves as a protector that protects the lateral edge 121*a* of the fixing belt 121 in the axial direction thereof. For example, even if the fixing belt 121 is skewed in the axial direction thereof, the slip ring 141 prevents the lateral edge 121*a* of the fixing belt 121 from coming into direct contact with the belt holder 140, thus minimizing abrasion and breakage of the lateral edge 121*a* of the fixing belt 121 in the axial direction thereof. Since an inner diameter of the slip ring 141 is sufficiently greater than an outer diameter of the belt holder 140, the slip ring 141 loosely slips on the belt holder 140. Accordingly, when the lateral edge 121*a* of the fixing belt 121 comes into contact with the slip ring 141, the slip ring 141 is rotatable in accordance with rotation of the fixing belt 121 by friction therebetween. Alternatively, the slip ring 141 may remain at rest irrespective of rotation of the fixing belt 121. The slip ring 141 is made of heat-resistant, super engineering plastics such as PEEK, PPS, PAI, and PTFE.

A shield is interposed between the halogen heater 123 and the fixing belt 121 at both lateral ends of the fixing belt 121 in the axial direction thereof. The shield shields the fixing belt 121 against heat from the halogen heater 123. For example, even if a plurality of small recording media P is conveyed through the fixing nip N continuously, the shield prevents heat from the halogen heater 123 from being conducted to both lateral ends of the fixing belt 121 in the axial direction thereof where the small recording media P are not conveyed. Accordingly, both lateral ends of the fixing belt 121 do not overheat even in the absence of large recording media P that draw heat therefrom. Consequently, the shield minimizes thermal wear and damage of the fixing belt 121.

With reference to FIG. 4, a description is provided of a fixing operation performed by the fixing device 100 described above.

As the image forming apparatus 1000 depicted in FIG. 3 is powered on, that is, as a main power switch 91 of the image forming apparatus 1000 is turned on, a warm-up operation starts. For example, power is supplied to the halogen heater 123 and at the same time the pressing roller driver 129 starts driving and rotating the pressing roller 122 clockwise in FIG. 4 in the rotation direction R4. Accordingly, the fixing belt 121 rotates counterclockwise in FIG. 4 in the rotation direction R3 in accordance with rotation of the pressing roller 122 by friction between the pressing roller 122 and the fixing belt 121. The halogen heater 123 heats the fixing belt 121 until the temperature sensor 127 detects that the temperature of the fixing belt 121 reaches a predetermined temperature, thus warming up the fixing belt 121. For example, in the warm-up operation upon turning on the main power switch 91 of the image forming apparatus 1000, the halogen heater 123 heats the fixing belt 121 to a target temperature Tt in a range of from about 158 degrees centigrade to about 170 degrees centigrade that is higher than a fixing temperature Tf at which a toner image T is fixed on a recording medium P.

When the temperature of the fixing belt 121 reaches the target temperature Tt, the controller 200 interrupts power supply to the halogen heater 123, thus cooling the fixing belt 121 to the fixing temperature Tf. A recording medium P bearing a toner image T formed by the image forming operation of the image forming apparatus 1000 described above is conveyed in the recording medium conveyance direction A1 while guided by a guide plate and enters the fixing nip N formed between the pressing roller 122 and the fixing belt 121 pressed by the pressing roller 122. Based on the temperature of the fixing belt 121 detected by the temperature sensor 127, the controller 200 controls power supply to the halogen heater 123 to maintain the temperature of the fixing belt 121 at the fixing temperature Tf. For example, when the temperature sensor 127 detects that the temperature of the fixing belt 121 is an increased temperature Ti that is higher than the fixing temperature Tf by a predetermined a degrees centigrade, the controller 200 interrupts power supply to the halogen heater 123. Conversely, when the temperature sensor 127 detects that the temperature of the fixing belt 121 is a decreased temperature Td that is lower than the fixing temperature Tf by the α degrees centigrade, the controller 200 resumes power supply to the halogen heater 123.

The fixing belt 121 heated by the halogen heater 123 heats the recording medium P and at the same time the pressing roller 122 pressed against the fixing belt 121 and the fixing belt 121 together exert pressure to the recording medium P, thus fixing the toner image T on the recording medium P. The recording medium P bearing the fixed toner image T is discharged from the fixing nip N in a recording medium conveyance direction A2. As a leading edge of the recording medium P comes into contact with a front edge of the separator 128, the separator 128 separates the recording medium P from the fixing belt 121. Thereafter, the separated recording medium P is discharged by the output roller pair 7 depicted in FIG. 3 onto the outside of the image forming apparatus 1000, that is, the output tray 17 where the recording medium P is stocked.

When the print job is finished, the fixing device 100 enters a standby mode or a sleep mode, that is, an energy saver mode. For example, in the standby mode, the temperature of the fixing belt 121 is maintained at a standby temperature Ts of about 90 degrees centigrade according to this exemplary embodiment, that is lower than the fixing temperature Tf, thus waiting for a next print job. In the sleep mode, power supply to the halogen heater 123 and transmission of a driving force from the pressing roller driver 129 to the pressing roller 122 are interrupted. A user, by using a control panel 151 described below, inputs an instruction to enter the fixing device 100 into the standby mode or the sleep mode after the print job is finished. If the user selects the standby mode, upon receipt of the next print job, the fixing belt 121 is warmed up to the fixing temperature Tf quickly, shortening waiting time until the next print job starts. Conversely, if the user selects the sleep mode, power consumption is minimized while the fixing device 100 waits for the next print job, saving energy. If the image forming apparatus 1000 waits for the next print job in the standby mode, warm-up of the fixing belt 121 is finished when the temperature of the fixing belt 121 reaches the fixing temperature Tf. Conversely, if the image forming apparatus 1000 waits for the next print job in the sleep mode, warm-up of the fixing belt 121 is finished when the temperature of the fixing belt 121 reaches the increased temperature Ti higher than the fixing temperature Tf.

Figure 6:
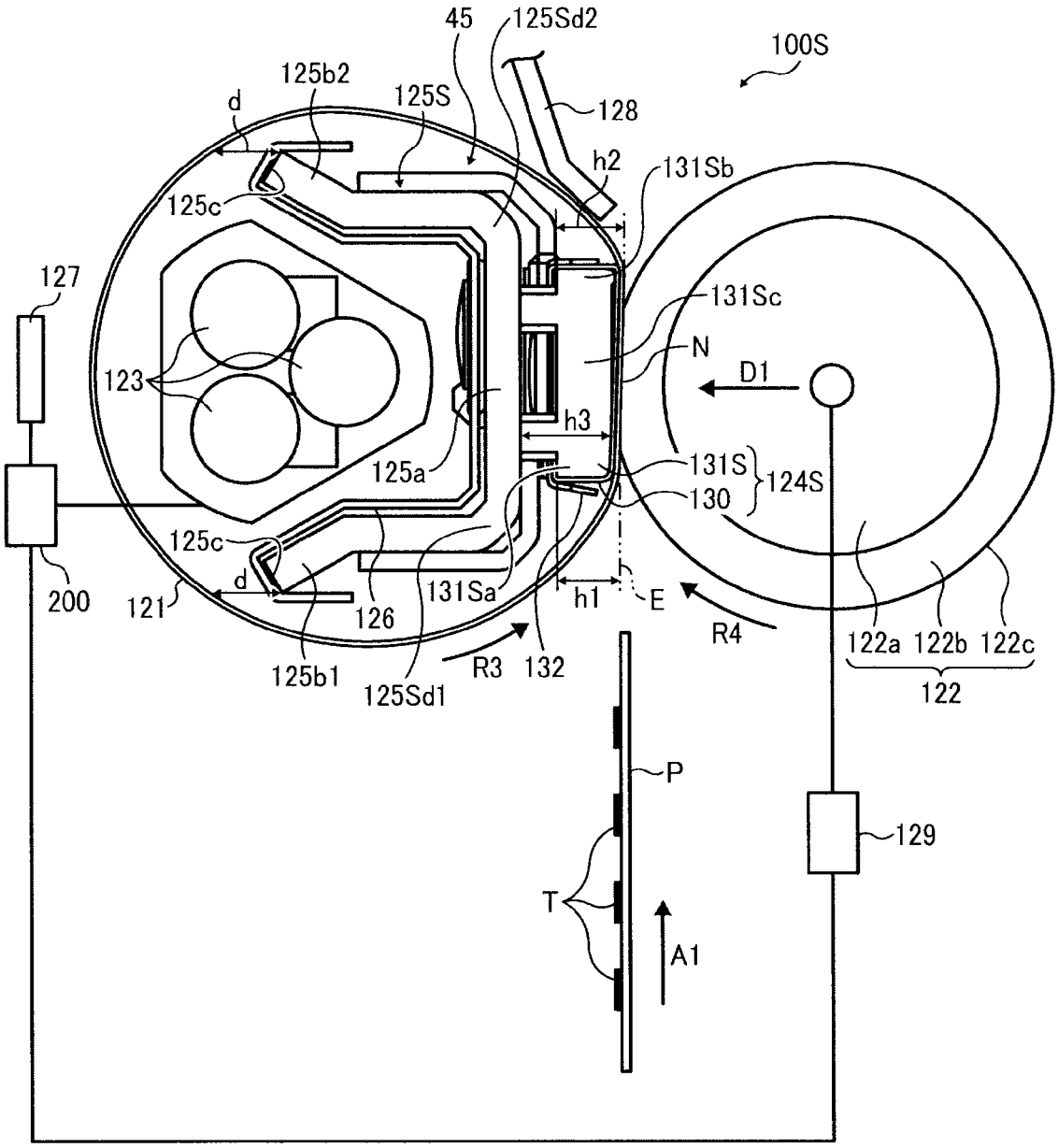
FIG. 6 is a vertical sectional view of a fixing device according to a second exemplary embodiment.

With reference to FIG. 6, a description is provided of a configuration of a fixing device 100S according to a second exemplary embodiment.

FIG. 6 is a schematic vertical sectional view of the fixing device 100S. The identical reference numerals are assigned to the components of the fixing device 100S that are also installed in the fixing device 100 depicted in FIGS. 4 to 5C. A description of such components is omitted.

Unlike the fixing device 100 depicted in FIG. 4, the fixing device 100S includes three halogen heaters 123 serving as heaters that heat the fixing belt 121. The three halogen heaters 123 have three different regions thereof in the axial direction of the fixing belt 121 that generate heat. Accordingly, the three halogen heaters 123 heat the fixing belt 121 in three different regions on the fixing belt 121, respectively, in the axial direction thereof so that the fixing belt 121 heats recording media P of various widths in the axial direction of the fixing belt 121. The fixing device 100S further includes a metal plate 132 that partially surrounds a nip formation assembly 124S. Thus, a substantially W-shaped stay 125S accommodating the three halogen heaters 123 supports the nip formation assembly 124S via the metal plate 132.

As shown in FIG. 6, in contrast to the stay 125S, the nip formation assembly 124S is compact, thus allowing the stay 125S to extend as long as possible in the small space inside the loop formed by the fixing belt 121. For example, the length of a base pad 131S of the nip formation assembly 124S is smaller than that of the stay 125S in the recording medium conveyance direction A1.

As shown in FIG. 6, the base pad 131S includes an upstream portion 131Sa disposed upstream from the fixing nip N in the recording medium conveyance direction A1; a downstream portion 131Sb disposed downstream from the fixing nip N in the recording medium conveyance direction A1; and a center portion 131Sc interposed between the upstream portion 131Sa and the downstream portion 131Sb in the recording medium conveyance direction A1. A height h1 defines a height of the upstream portion 131Sa from the fixing nip N or its hypothetical extension E in a pressurization direction D1 of the pressing roller 122 in which the pressing roller 122 is pressed against the nip formation assembly 124S. A height h2 defines a height of the downstream portion 131Sb from the fixing nip N or its hypothetical extension E in the pressurization direction D1 of the pressing roller 122. A height h3, that is, a maximum height of the base pad 131S, defines a height of the center portion 131Sc from the fixing nip N or its hypothetical extension E in the pressurization direction D1 of the pressing roller 122. The height h3 is not smaller than the height h1 and the height h2.

Hence, the upstream portion 131Sa of the base pad 131S of the nip formation assembly 124S is not interposed between the inner circumferential surface of the fixing belt 121 and an upstream curve 125Sd1 of the stay 125S in a diametrical direction of the fixing belt 121. Similarly, the downstream portion 131Sb of the base pad 131S of the nip formation assembly 124S is not interposed between the inner circumferential surface of the fixing belt 121 and a downstream curve 125Sd2 of the stay 125S in the diametrical direction of the fixing belt 121. Accordingly, the upstream curve 125Sd1 and the downstream curve 125Sd2 of the stay 125S are situated in proximity to the inner circumferential surface of the fixing belt 121. Consequently, the stay 125S having an increased size that enhances the mechanical strength thereof is accommodated in the limited space inside the loop formed by the fixing belt 121. As a result, the stay 125S, with its enhanced mechanical strength, supports the nip formation assembly 124S properly, preventing bending of the nip formation assembly 124S caused by pressure from the pressing roller 122 and thereby improving fixing performance.

As shown in FIG. 6, the stay 125S includes a base 125*a* contacting the nip formation assembly 124S and an upstream arm 125*b*1 and a downstream arm 125*b*2, constituting a pair of projections, projecting from the base 125*a*. The base 125*a* extends in the recording medium conveyance direction A1, that is, a vertical direction in FIG. 6. The upstream arm 125*b*1 and the downstream arm 125*b*2 project from an upstream end and a downstream end of the base 125*a*, respectively, in the recording medium conveyance direction A1 and extend in the pressurization direction D1 of the pressing roller 122 orthogonal to the recording medium conveyance direction A1. The upstream arm 125*b*1 and the downstream arm 125*b*2 projecting from the base 125*a* in the pressurization direction D1 of the pressing roller 122 elongate a cross-sectional area of the stay 125S in the pressurization direction D1 of the pressing roller 122, increasing the section modulus and the mechanical strength of the stay 125S.

Additionally, as the upstream arm 125*b*1 and the downstream arm 125*b*2 elongate further in the pressurization direction D1 of the pressing roller 122, the mechanical strength of the stay 125S becomes greater. Accordingly, it is preferable that a front edge 125*c* of each of the upstream arm 125*b*1 and the downstream arm 125*b*2 is situated as close as possible to the inner circumferential surface of the fixing belt 121 to allow the upstream arm 125*b*1 and the downstream arm 125*b*2 to project longer from the base 125*a* in the pressurization direction D1 of the pressing roller 122. However, since the fixing belt 121 swings or vibrates as it rotates, if the front edge 125*c* of each of the upstream arm 125*b*1 and the downstream arm 125*b*2 is excessively close to the inner circumferential surface of the fixing belt 121, the swinging or vibrating fixing belt 121 may come into contact with the upstream arm 125*b*1 or the downstream arm 125*b*2. For example, if the thin fixing belt 121 is used as in this exemplary embodiment, the thin fixing belt 121 swings or vibrates substantially. Accordingly, it is necessary to position the front edge 125*c* of each of the upstream arm 125*b*1 and the downstream arm 125*b*2 with respect to the fixing belt 121 carefully.

Specifically, as shown in FIG. 6, a distance d between the front edge 125*c* of each of the upstream arm 125*b*1 and the downstream arm 125*b*2 and the inner circumferential surface of the fixing belt 121 in the pressurization direction D1 of the pressing roller 122 is at least about 2.0 mm, preferably not smaller than about 3.0 mm. Conversely, if the fixing belt 121 is thick and therefore barely swings or vibrates, the distance d is about 0.02 mm. It is to be noted that if the reflector 126 is attached to the front edge 125*c* of each of the upstream arm 125*b*1 and the downstream arm 125*b*2 as in this exemplary embodiment, the distance d is determined by considering the thickness of the reflector 126 so that the reflector 126 does not contact the fixing belt 121.

The front edge 125*c* of each of the upstream arm 125*b*1 and the downstream arm 125*b*2 situated as close as possible to the inner circumferential surface of the fixing belt 121 allows the upstream arm 125*b*1 and the downstream arm 125*b*2 to project longer from the base 125*a* in the pressurization direction D1 of the pressing roller 122. Accordingly, even if the fixing belt 121 has a decreased loop diameter, the stay 125S having the longer upstream arm 125*b*1 and the longer downstream arm 125*b*2 attains an enhanced mechanical strength.

With reference to FIGS. 4 and 6, a description is provided of advantages of the fixing devices 100 and 100S having the configuration described above.

The nip formation assembly (e.g., the nip formation assemblies 124 and 124S) guides the fixing belt 121 to the fixing nip N, minimizing vibration or swinging of the fixing belt 121 before the fixing belt 121 enters the fixing nip N and thereby facilitating stable and smooth entry of the fixing belt 121 into the fixing nip N. Accordingly, even if no guide other than the nip formation assembly is configured to guide a center interposed between both lateral ends of the fixing belt 121 in the axial direction thereof to the fixing nip N, the nip formation assembly guides and rotates the fixing belt 121 stably and smoothly. Consequently, the nip formation assembly minimizes load imposed on the rotating fixing belt 121 and resultant wear of the fixing belt 121, preventing damage and breakage of the fixing belt 121 and enhancing reliability of the fixing devices 100 and 100S. For example, it is difficult for the fixing belt 121 having a reduced thickness that decreases the thermal capacity thereof to have an increased mechanical strength. However, the nip formation assembly supports and guides the thin fixing belt 121, preventing damage and breakage of the fixing belt 121.

The nip formation assembly incorporated in the fixing devices 100 and 100S guides the fixing belt 121 to the fixing nip N, resulting in the simple, compact fixing devices 100 and 100S manufactured at reduced costs. Accordingly, the compact fixing devices 100 and 100S have a reduced thermal capacity that shortens a warm-up time thereof, thus saving more energy and shortening a first print time taken to output a recording medium P bearing a toner image T onto the outside of the image forming apparatus 1000 after the image forming apparatus 1000 receives a print job.

As shown in FIG. 6, since the nip formation assembly 124S serves as a guide that guides the fixing belt 121 to the fixing nip N, it is not necessary to provide a guide separately from the nip formation assembly 124S. Hence, no component is interposed between the inner circumferential surface of the fixing belt 121 and the upstream curve 125Sd1 of the stay 125S in the diametrical direction of the fixing belt 121. Similarly, no component is interposed between the inner circumferential surface of the fixing belt 121 and the downstream curve 125Sd2 of the stay 125S in the diametrical direction of the fixing belt 121. That is, the upstream curve 125Sd1 and the downstream curve 125Sd2 of the stay 125S are disposed opposite the inner circumferential surface of the fixing belt 121 directly. Accordingly, the upstream curve 125Sd1 and the downstream curve 125Sd2 of the stay 125S are situated in proximity to the inner circumferential surface of the fixing belt 121. Consequently, the stay 125S having an increased size that enhances the mechanical strength thereof is accommodated in the limited space inside the loop formed by the fixing belt 121. As a result, even if the fixing belt 121 is downsized to decrease its thermal capacity, the stay 125S accommodated inside the downsized fixing belt 121 achieves an enhanced mechanical strength that supports the nip formation assembly 124S properly, preventing bending of the nip formation assembly 124S caused by pressure from the pressing roller 122 and thereby improving fixing performance.

While the pressing roller 122 is isolated from the fixing belt 121, the nip formation assembly 124S is spaced apart from the inner circumferential surface of the fixing belt 121 so that the upstream portion 131Sa and the downstream portion 131Sb of the base pad 131S of the nip formation assembly 124S do not pressingly contact the fixing belt 121. Accordingly, the fixing belt 121 does not slide over the nip formation assembly 124S, minimizing load imposed on the fixing belt 121 and resultant abrasion of the fixing belt 121. Additionally, the fixing belt 121 contacts the nip formation assembly 124S with a reduced friction therebetween, producing a desired path through which the fixing belt 121 enters the fixing nip N.

If the pressing roller 122 is configured to rotate at an increased speed to convey an increased number of recording media P per minute, a thermistor, that is, a pressing roller thermistor, that detects the temperature of the pressing roller 122 may be provided. For example, if the image forming apparatus 1000 is a high-speed image forming apparatus, the pressing roller 122 need to rotate at an increased speed to convey the recording medium P quickly. Accordingly, the fixing belt 121 also rotates at an increased speed in accordance with rotation of the pressing roller 122 and therefore is heated by the halogen heater 123 for a decreased time. Consequently, the fixing belt 121 may be heated insufficiently. To address this problem, after the temperature sensor 127 and the pressing roller thermistor detect that the surface temperature of each of the fixing belt 121 and the pressing roller 122 reaches the fixing temperature Tf during warm-up of the fixing belt 121, the controller 200 starts conveying the recording medium P through the fixing nip N. Accordingly, the pressing roller 122 and the fixing belt 121 start conveying the recording medium P after the pressing roller 122 stores a sufficient amount of heat, thus preventing insufficient heating of the fixing belt 121.

Further, another thermistor may be disposed opposite a lateral end of the pressing roller 122 in the axial direction thereof, that is, a non-passage region where a small recording medium P does not pass, so as to detect the temperature of the non-passage region of the pressing roller 122. For example, after a plurality of small recording media P is conveyed through the fixing nip N formed between the pressing roller 122 and the fixing belt 121 continuously, both lateral ends of the pressing roller 122 and the fixing belt 121 in the axial direction thereof may overheat because the small recording media P do not pass over both lateral ends of the pressing roller 122 and the fixing belt 121 and therefore do not draw heat therefrom, resulting in malfunction of the fixing devices 100 and 100S. To address this problem, when the thermistor disposed opposite the non-passage region of the pressing roller 122 where the small recording media P do not pass detects that the temperature of the non-passage region of the pressing roller 122 exceeds a predetermined temperature, the controller 200 stops the fixing devices 100 and 100S.

Figure 7:
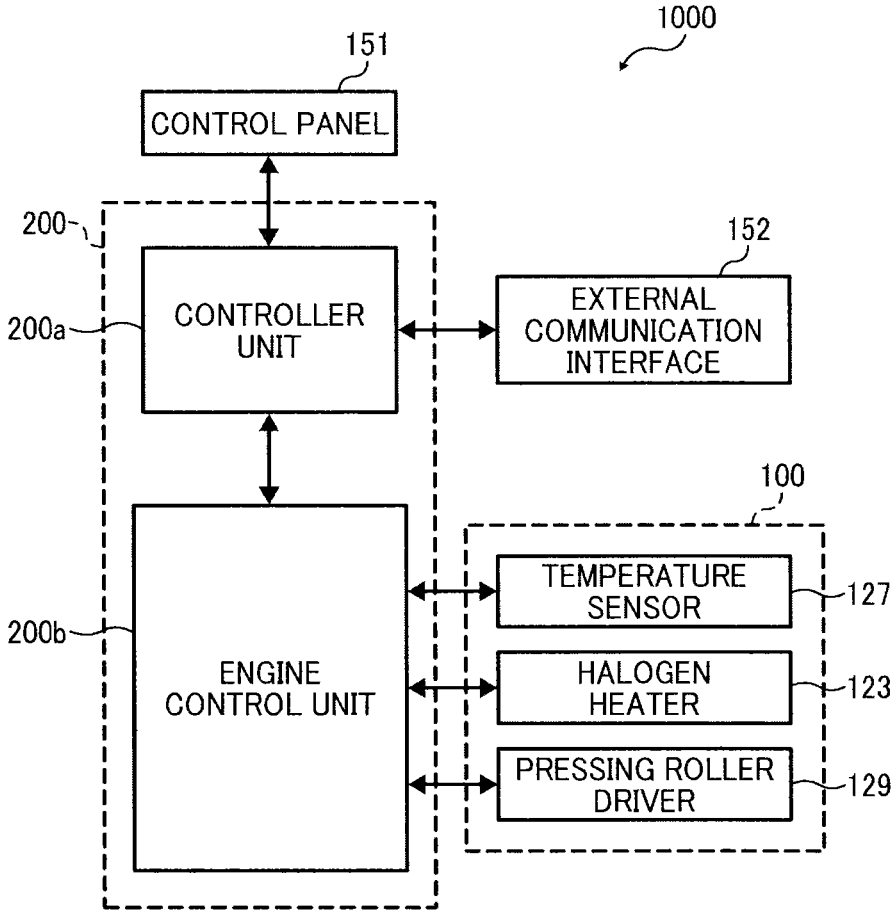
FIG. 7 is a block diagram of a controller incorporated in the image forming apparatus shown in FIG. 3.

With reference to FIG. 7, a detailed description is now given of a configuration of the controller 200 installable in the fixing devices 100 and 100S depicted in FIGS. 4 and 6, respectively.

FIG. 7 is a block diagram of the controller 200 for controlling the fixing device 100. As shown in FIG. 7, the controller 200 includes a controller unit 200*a* and an engine control unit 200*b*.

The controller unit 200*a* including the CPU, the ROM, and the RAM is operatively connected to the engine control unit 200*b*, the control panel 151, and an external communication interface 152. The controller unit 200*a*, by executing a preloaded control program, controls operation of the entire image forming apparatus 1000 and input from the external communication interface 152 and the control panel 151. For example, the controller unit 200*a* receives an instruction input by the user using the control panel 151 disposed atop the image forming apparatus 1000 and performs various processes according to the instruction. Additionally, the controller unit 200*a* receives a print job, that is, an image forming job, and image data from an external client computer through the external communication interface 152 and controls the engine control unit 200*b*, thus controlling an image forming operation to form a toner image T, that is, a monochrome toner image T and a color toner image T, on a recording medium P and output the recording medium P bearing the toner image T.

The engine control unit 200*b* is operatively connected to the controller unit 200*a*, the temperature sensor 127, the halogen heater 123, and the pressing roller driver 129 incorporated in the fixing device 100. The engine control unit 200*b* including the CPU, the ROM, and the RAM, by executing a preloaded control program, controls a printer engine including the plurality of image forming units 2Y, 2C, 2M, and 2K, the optical writer 8, and the fixing device 100 depicted in FIG. 3, that performs the image forming processes described above according to an instruction from the controller unit 200*a*. For example, the engine control unit 200*b*, in an image forming mode to form a toner image T on a recording medium P, controls the halogen heater 123 to heat the fixing belt 121 to a predetermined temperature based on the temperature of the fixing belt 121 detected by the temperature sensor 127 and controls the pressing roller driver 129 to drive and rotate the pressing roller 122.

With reference to FIG. 4, a description is provided of three modes of the image forming apparatus 1000 incorporating the fixing device 100, that is, the image forming mode to perform the image forming operation described above; the standby mode to wait for an instruction to start the image forming operation; and the sleep mode to wait for an instruction to start the image forming operation while consuming less power than the standby mode.

It is to be noted that the description below is also applicable to the image forming apparatus 1000 incorporating the fixing device 100S depicted in FIG. 6. For example, in the image forming mode, the fixing belt 121 of the fixing device 100 is warmed up to the target temperature Tt in a range of from about 158 degrees centigrade to about 170 degrees centigrade, and then the fixing device 100 performs the fixing operation described above of fixing the toner image T on the recording medium P. In the standby mode, the fixing belt 121 of the fixing device 100 is maintained at the standby temperature Ts of about 90 degrees centigrade lower than the target temperature Tt set in the image forming mode. In the sleep mode, power is not supplied to the engine control unit 200*b* depicted in FIG. 7 and the printer engine including the fixing device 100, and thus the halogen heater 123 and the pressing roller 122 are turned off.

As described above, the stay 125 is made of thermally conductive metal such as stainless steel and iron and mounted on the side plates 142 depicted in FIG. 5A that are also made of metal such as stainless steel and iron. Accordingly, heat conducted and stored from the halogen heater 123 and the fixing belt 121 to the stay 125 is further conducted to the side plates 142 and then dissipated inside the image forming apparatus 1000.

If the main power switch 91 of the image forming apparatus 1000 depicted in FIG. 3 is turned on while the fixing device 100 is at ambient temperature, it takes substantial time to warm up the fixing belt 121 to the target temperature Tt because heat conducted from the halogen heater 123 to the fixing belt 121 dissipates therefrom to the components surrounding the fixing belt 121 that are at ambient temperature. Accordingly, the components situated inside the loop formed by the fixing belt 121 such as the stay 125 are heated sufficiently as the fixing belt 121 is warmed up for the substantial time. Hence, during a first print job, that is, a first fixing job or a first fixing operation, after the main power switch 91 is turned on, the stay 125 also stores heat sufficiently. Since the halogen heater 123 remains turned on during the first fixing operation to maintain the temperature of the fixing belt 121 at the fixing temperature Tf, heat is conducted from the halogen heater 123 and the fixing belt 121 to the stay 125 throughout the first fixing operation, thus minimizing temperature decrease of the stay 125. Hence, the fixing belt 121 heats the toner image Ton the recording medium P sufficiently, thus fixing the toner image T on the recording medium P properly.

When the first print job upon turning on the main power switch 91 is finished, the fixing belt 121 and its surroundings situated inside the fixing device 100 have been warmed up sufficiently. However, the components situated inside the image forming apparatus 1000 other than the fixing device 100 have not been warmed up sufficiently. Accordingly, while the image forming apparatus 1000 waits for a second print job, that is, a second fixing job or a second fixing operation, in the standby mode or the sleep mode after the first print job is finished, heat conducted from the stay 125 to the side plates 142 dissipates inside the image forming apparatus 1000. Consequently, while the image forming apparatus 1000 waits for the second print job after the first print job is finished, heat stored in the stay 125 decreases and thus the temperature of the stay 125 decreases.

While the fixing belt 121 is warmed up upon receipt of the second print job, since the fixing belt 121 and its surroundings inside the fixing device 100 have been warmed up during the first print job, dissipation of heat from the fixing belt 121 is minimized and therefore the fixing belt 121 is heated to the target temperature Tt quickly. Accordingly, the warm-up time of the fixing belt 121 upon receipt of the second print job is shorter than the warm-up time of the fixing belt 121 upon receipt of the first print job. Consequently, during a second warm-up of the fixing belt 121 upon receipt of the second print job, less heat is conducted to the stay 125 compared to during a first warm-up of the fixing belt 121 upon receipt of the first print job. That is, the stay 125 stores heat insufficiently and therefore has a decreased temperature. As a result, during the second print job, the stay 125 draws an increased amount of heat from the fixing belt 121, hindering the fixing belt 121 from heating the toner image T on the recording medium P sufficiently and thus causing cold offset. When the second print job is finished, the components situated inside the image forming apparatus 1000 have been warmed up sufficiently, minimizing dissipation of heat from the side plates 142. Accordingly, while the image forming apparatus 1000 waits for a third print job, that is, a third fixing job or a third fixing operation, temperature decrease of the stay 125 is minimized. Consequently, during the third print job and later, heat drawn from the fixing belt 121 to the stay 125 is minimized and thereby cold offset does not occur.

On the other hand, the image forming apparatus 1000 may be configured to enter the standby mode or the sleep mode after the fixing belt 121 maintained at a predetermined temperature rotates for about 15 seconds after a trailing edge of the last recording medium P of the first print job passes through the fixing nip N. However, a sufficient amount of heat is not conducted to the stay 125 while the fixing belt 121 rotates for about 15 seconds. Accordingly, cold offset may occur during the second print job.

To address this problem, the fixing device 100 performs a transition operation in which the fixing belt 121 and the pressing roller 122 rotate for a predetermined time while the temperature of the fixing belt 121 is maintained at the predetermined temperature after the trailing edge of the last recording medium P of each fixing job passes through the fixing nip N. A time T1 for which a first transition operation is performed after the trailing edge of the last recording medium P of the first fixing job passes through the fixing nip N is longer than a time T2 for which a second transition operation is performed after the trailing edge of the last recording medium P of the second fixing job or later passes through the fixing nip N, a detailed description of which is given below. For example, a sensor, disposed downstream from the fixing nip N in the recording medium conveyance direction A1, detects the trailing edge of the recording medium P discharged from the fixing nip N.

Figure 8:
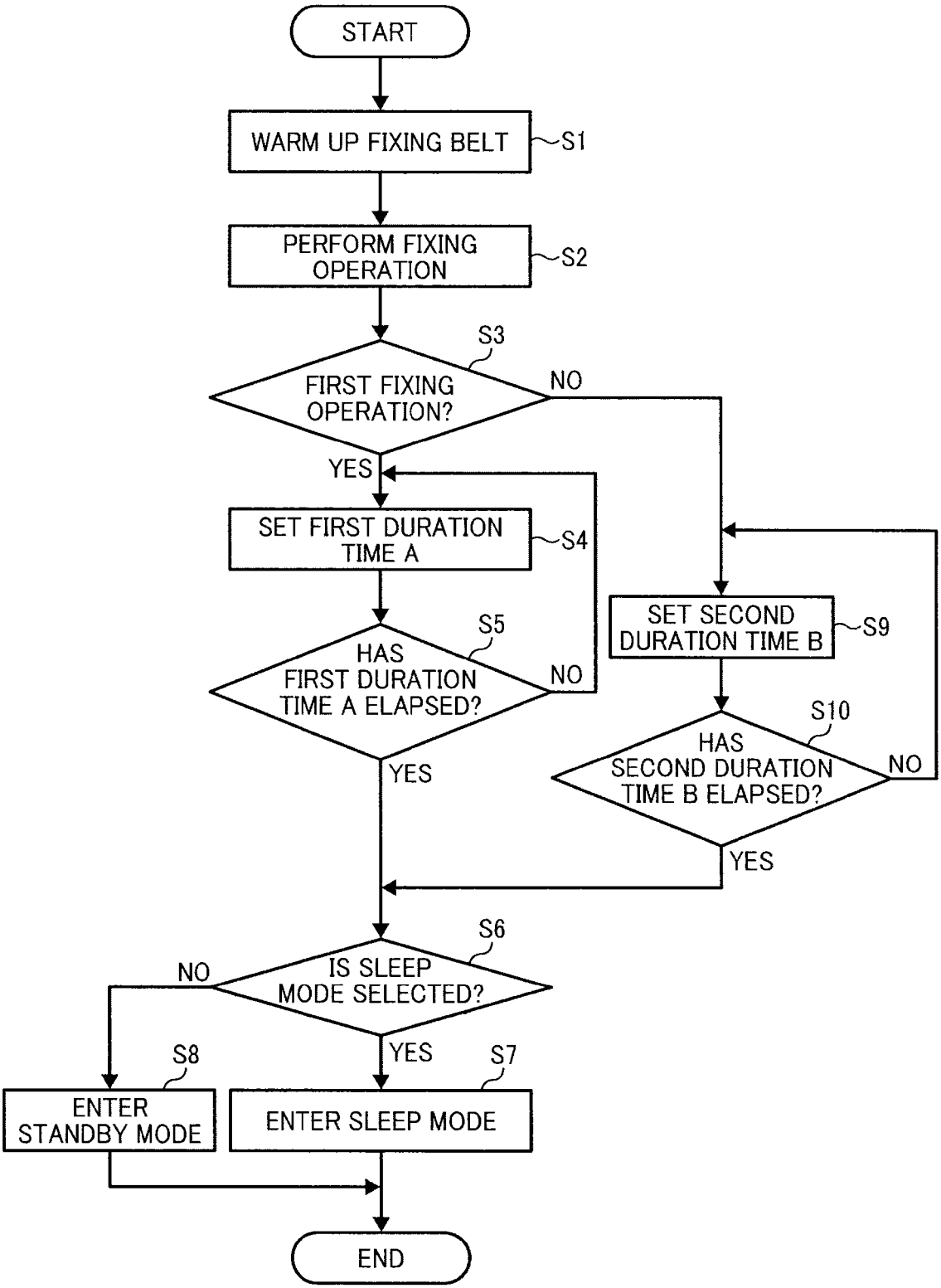
FIG. 8 is a flowchart illustrating a control operation performed by the controller shown in FIG. 7.

FIG. 8 is a flowchart illustrating a control operation of the image forming apparatus 1000 incorporating the fixing device 100 depicted in FIG. 4. It is to be noted that the control operation shown in FIG. 8 is also applicable to the image forming apparatus 1000 incorporating the fixing device 100S depicted in FIG. 6.

As shown in FIGS. 7 and 8, as the controller 200 of the image forming apparatus 1000 receives a print job from the external client computer, for example, via the external communication interface 152, the controller 200 controls the halogen heater 123 to warm up the fixing belt 121 to the target temperature Tt in step S1. The target temperature Tt varies depending on the mode of the image forming apparatus 1000 in which it waits for the print job. For example, if the image forming apparatus 1000 waits for the print job after the main power switch 91 is turned on or in the sleep mode, the target temperature Tt is set higher than the fixing temperature Tf at which the toner image T is fixed on the recording medium P. Conversely, if the image forming apparatus 1000 waits for the print job in the standby mode, the target temperature Tt is set to the fixing temperature Tf. According to this exemplary embodiment, the target temperature Tt is in a range of from about 158 degrees centigrade to about 170 degrees centigrade.

When the temperature sensor 127 detects that the temperature of the fixing belt 121 reaches the target temperature Tt, the controller 200 finishes warm-up of the fixing belt 121 and starts the fixing operation, that is, the print job, in step S2. For example, if the target temperature Tt is set higher than the fixing temperature Tf, the controller 200 starts the fixing operation when the temperature of the fixing belt 121 decreases to the fixing temperature Tf. Conversely, if the target temperature Tt is set to the fixing temperature Tf, the controller 200 starts the fixing operation immediately after the temperature of the fixing belt 121 reaches the target temperature Tt and therefore warm-up of the fixing belt 121 is finished.

In step S3, the controller 200 determines whether or not the fixing operation performed is the first fixing operation, that is, the first fixing job, received after the main power switch 91 is turned on, that is, after the fixing device 100 is powered on. If the fixing operation performed is the first fixing operation (YES in step S3), the time T1 for which the first transition operation is performed after the trailing edge of the last recording medium P of the first fixing job passes through the fixing nip N is set to a first duration time A in step S4. Conversely, if the fixing operation performed is not the first fixing operation (NO in step S3), the time T2 for which the second transition operation is performed after the trailing edge of the last recording medium P of the second fixing job or later passes through the fixing nip N is set to a second duration time B in step S9.

In step S5, the controller 200 determines whether or not the first duration time A has elapsed. If the controller 200 determines that the first duration time A has elapsed (YES in step S5), the controller 200 determines whether or not to enter the sleep mode, for example, whether or not the sleep mode is selected by the user, in step S6. If the controller 200 determines to enter the sleep mode (YES in step S6), that is, if the controller 200 receives an instruction to enter the sleep mode from the control panel 151, the controller 200 causes the fixing device 100 to enter the sleep mode by interrupting power supply to the halogen heater 123 and rotation of the pressing roller 122 and the fixing belt 121 in step S7. Conversely, if the controller 200 determines not to enter the sleep mode (NO in step S6), that is, if the controller 200 receives an instruction to enter the standby mode from the control panel 151, the controller 200 causes the fixing device 100 to enter the standby mode by maintaining the fixing belt 121 at the standby temperature Ts and rotating the pressing roller 122 and the fixing belt 121 in step S8. On the other hand, in step S10, the controller 200 determines whether or not the second duration time B has elapsed. If the controller 200 determines that the second duration time B has elapsed (YES in step S10), the controller 200 determines whether or not to enter the sleep mode in step S6.

It is to be noted that the first duration time A is longer than the second duration time B. For example, the first duration time A of the first transition operation after the main power switch 91 is turned on is about 60 seconds that is long enough to store a sufficient amount of heat in the stay 125. Conversely, the second duration time B of the second transition operation subsequent to the second fixing job or later is about 15 seconds that is short enough to start the next fixing job immediately after the trailing edge of the last recording medium P of the second fixing job or later passes through the fixing nip N. Alternatively, the second duration time B may be zero second that is short enough to enter the standby mode or the sleep mode immediately after the trailing edge of the last recording medium P of the second fixing job or later passes through the fixing nip N.

As described above, after the tailing edge of the last recording medium P of the first or second fixing job passes through the fixing nip N, the first or second transition operation is performed in which the fixing belt 121 and the pressing roller 122 rotate for the first duration time A or the second duration time B, respectively, while the temperature of the fixing belt 121 is maintained in a range of from about 158 degrees centigrade to about 170 degrees centigrade. The first duration time A applied to the first transition operation subsequent to the first fixing operation after the main power switch 91 is turned on is longer than the second duration time B applied to the second transition operation subsequent to the second fixing operation or later. Accordingly, during the first transition operation, the stay 125 receives a sufficient amount of heat conducted from the halogen heater 123 and the fixing belt 121, thus storing an increased amount of heat. Accordingly, even if the side plates 142 draw heat from the stay 125 in the standby mode or the sleep mode, that is, at an interval between the first fixing job and the second fixing job, and the side plates 142 dissipate heat into the interior of the image forming apparatus 1000, the stay 125 storing the increased amount of heat maintains an increased temperature during the second fixing job compared to a configuration without the first transition operation. Consequently, the stay 125 does not draw heat from the fixing belt 121 during the second fixing job, that is, the second fixing operation, thus minimizing cold offset.

Alternatively, the user may change, by using the control panel 151, the predetermined temperature (e.g., the target temperature Tt and the fixing temperature TO of the fixing belt 121 and the first duration time A applied to the first transition operation subsequent to the first fixing operation. For example, if the image forming apparatus 1000 is used under relatively high temperature, the user may decrease the predetermined temperature of the fixing belt 121 by using the control panel 151 serving as a user interface or an adjuster, thus reducing power consumption during the first transition operation subsequent to the first fixing operation. Conversely, if the image forming apparatus 1000 is used under relatively low temperature, the user may increase the predetermined temperature of the fixing belt 121 by using the control panel 151, thus minimizing cold offset during the second fixing job.

Yet alternatively, if the user turns on and off the main power switch 91 frequently, the user may shorten the first duration time A applied to the first transition operation subsequent to the first fixing operation after the main power switch 91 is turned on, thus reducing power consumption.

Table 1 below shows an example of settings of the predetermined temperature of the fixing belt 121 and the first duration time A for the first transition operation subsequent to the first fixing operation that the user can specify by using the control panel 151.

TABLE 1

| | Minimum unit | Maximum value | Minimum value | Default |
|---|---|---|---|---|
| Predetermined temperature of the fixing belt 121 (degrees centigrade) | 1 | 180 | 0 | 158 |
| First duration time A (seconds) | 1 | 100 | 0 | 60 |

As shown in Table 1, the predetermined temperature of the fixing belt 121 is set every one degree centigrade in a range of from 0 degree centigrade to 180 degrees centigrade. The first duration time A is set every one second in a range of from 0 second to 100 seconds. The default predetermined temperature of the fixing belt 121 is 158 degrees centigrade. The default first duration time A is 60 seconds.

Alternatively, when thick paper having an increased paper weight is to pass through the fixing nip N in the first fixing operation, the controller 200 may automatically set an increased temperature as the predetermined temperature of the fixing belt 121 for the first transition operation subsequent to the first fixing operation.

Yet alternatively, the image forming apparatus 1000 may incorporate a temperature sensor serving as a temperature detector that detects the temperature of the interior of the image forming apparatus 1000 so that the controller 200 automatically changes the predetermined temperature of the fixing belt 121 based on the temperature of the interior of the image forming apparatus 1000 detected by the temperature sensor. For example, if the temperature sensor detects a decreased temperature of the interior of the image forming apparatus 1000, the controller 200 changes the predetermined temperature of the fixing belt 121 to an increased temperature for the first transition operation subsequent to the first fixing operation.

Figure 9:
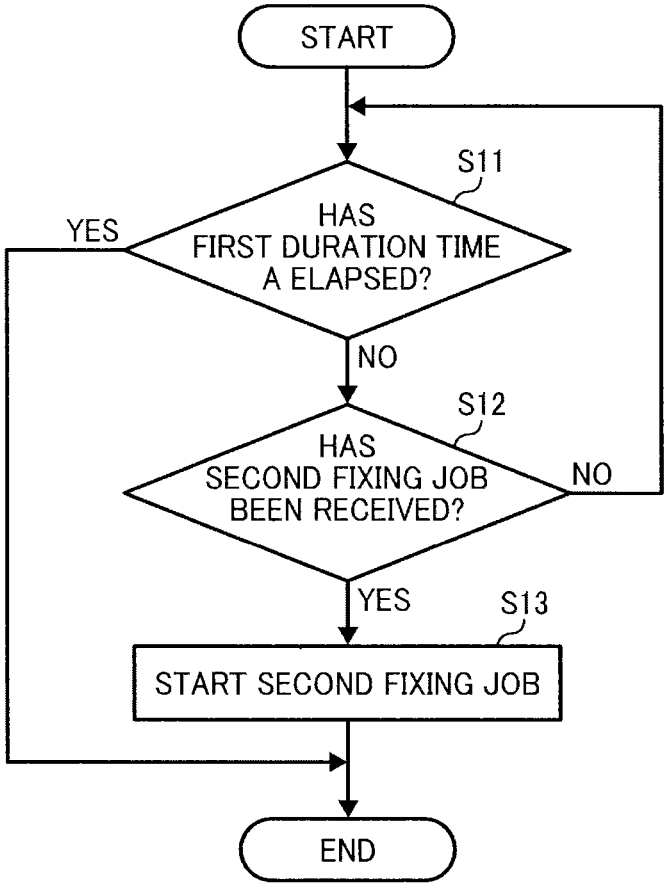
FIG. 9 is a flowchart illustrating another control operation performed by the controller shown in FIG. 7.

With reference to FIG. 9, a description is provided of a variation of the control operation depicted in FIG. 8 of the image forming apparatus 1000 incorporating the fixing device 100 depicted in FIG. 4.

FIG. 9 is a flowchart illustrating control processes of the first transition operation subsequent to the first fixing operation, that is, the first fixing job, received by the image forming apparatus 1000 incorporating the fixing device 100. It is to be noted that the control operation shown in FIG. 9 is also applicable to the image forming apparatus 1000 incorporating the fixing device 100S depicted in FIG. 6.

As shown in FIG. 9, if the image forming apparatus 1000 receives the second print job, that is the second fixing job, during the first transition operation subsequent to the first fixing operation, that is, the first fixing job, the image forming apparatus 1000 quits the first transition operation and starts the second fixing operation, that is, the second fixing job, to fix the toner image T on the recording medium P. For example, as the first transition operation starts subsequently to the first fixing operation, the controller 200 determines whether or not the first duration time A has elapsed in step S11. If the controller 200 determines that the first duration time A has not elapsed (NO in step S11), the controller 200 determines whether or not the image forming apparatus 1000 has received the second print job, that is, the second fixing job, in step S12. If the controller 200 determines that the image forming apparatus 1000 has received the second fixing job (YES in step S12), the controller 200 starts the second fixing operation, that is, the second fixing job, before the first duration time A has elapsed in step S13.

As described above, if the image forming apparatus 1000 receives the second fixing job during the first transition operation subsequent to the first fixing job, the controller 200 stops the first transition operation and starts the second fixing job. Thus, the image forming apparatus 1000 starts the second fixing job quickly. The first transition operation is performed immediately after the first fixing job is finished, that is, after the trailing edge of the last recording medium P of the first fixing job passes through the fixing nip N. Accordingly, the stay 125, during the first transition operation, stores heat sufficiently. Consequently, even if the fixing device 100 quits the first transition operation subsequent to the first fixing job and starts the second fixing operation, that is, the second fixing job, the stay 125 is not subject to shortage of heat during the second fixing operation, preventing cold offset.

With reference to FIGS. 3, 4, 6, 8, and 9, a description is provided of advantages of the fixing devices 100 and 100S and the image forming apparatus 1000 incorporating the fixing device 100 or 100S according to the exemplary embodiments described above.

As shown in FIGS. 4 and 6, each of the fixing devices 100 and 100S serves as a fixing device that includes the fixing belt 121 serving as a hollow, endless rotary body rotatable in a predetermined direction of rotation (e.g., the rotation direction R3); the halogen heater 123 serving as a heater that heats the fixing belt 121; the pressing roller 122 serving as a pressing rotary body contacting the outer circumferential surface of the fixing belt 121; and the nip formation set 45 constructed of the nip formation assembly (e.g., the nip formation assemblies 124 and 124S) and the stay (e.g., the stays 125 and 125S) disposed opposite the inner circumferential surface of the fixing belt 121 and pressing against the pressing roller 122 via the fixing belt 121 to form the fixing nip N between the fixing belt 121 and the pressing roller 122. The fixing belt 121 is rotatable in accordance with rotation of the pressing roller 122. The fixing device further includes the controller 200 operatively connected to the halogen heater 123 and at least one of the pressing roller 122 and the fixing belt 121 to perform a first fixing operation to fix the toner image on the first recording medium after the fixing device is powered on; a first transition operation subsequent to the first fixing operation, after the trailing edge of the first recording medium passes through the fixing nip N, in which the controller 200 rotates the pressing roller 122 and the fixing belt 121 while maintaining the temperature of the fixing belt 121 at a predetermined temperature; a second fixing operation to fix the toner image on the second recording medium; and a second transition operation subsequent to the second fixing operation, after the trailing edge of the second recording medium passes through the fixing nip N, in which the controller 200 rotates the pressing roller 122 and the fixing belt 121 while maintaining the temperature of the fixing belt 121 at the predetermined temperature. The first duration time A for which the first transition operation is performed is longer than the second duration time B for which the second transition operation is performed. Accordingly, the fixing device minimizes cold offset that may occur during the second fixing operation after the fixing device is powered on.

As shown in FIG. 7, the fixing device further includes the control panel 151 serving as a user interface or an adjuster that changes the first duration time A for which the first transition operation is performed and the predetermined temperature of the fixing belt 121. Accordingly, the fixing device minimizes cold offset that may arise during the second fixing operation and reduces power consumption.

As shown in FIG. 8, after the first transition operation and the second transition operation, the controller 200 interrupts power supply to the halogen heater 123 and halts the pressing roller 122 and the fixing belt 121 in the sleep mode. The sleep mode saves power that may be consumed while the fixing device waits for the next fixing operation in the standby mode in which the halogen heater 123 heats the fixing belt 121 at the standby temperature Ts.

As shown in FIG. 9, if the controller 200 receives a signal to start the second fixing operation during the first transition operation, the controller 200 quits the first transition operation and starts the second fixing operation. Accordingly, the fixing device starts the second fixing operation quickly without making the user wait for the second fixing operation. Since the first transition operation is subsequent to the first fixing operation, the nip formation set 45 stores heat sufficiently during the first transition operation. Hence, even if the controller 200 quits the first transition operation and starts the second fixing operation, the nip formation set 45 may not be short of heat during the second fixing operation and therefore may not draw heat from the fixing belt 121, preventing cold offset that may occur due to decreased temperature of the fixing belt 121.

As shown in FIGS. 4 and 6, the at least one halogen heater 123 heats the fixing belt 121 directly by radiation heat. Accordingly, the halogen heater 123 heats the fixing belt 121 quickly, saving energy and shortening the first print time taken to output the recording medium P bearing the fixed toner image T onto the outside of the image forming apparatus 1000 after the image forming apparatus 1000 receives a print job.

As shown in FIGS. 3, 4, and 6, the image forming apparatus 1000 includes the image forming device 99, constructed of the optical writer 8, the image forming station 1, and the transfer device 71, that forms a toner image T on a recording medium P and the fixing device 100 or 100S that fixes the toner image T on the recording medium P. That is, the image forming apparatus 1000 incorporating the fixing device 100 or 100S described above forms the high quality toner image T on the recording medium P.

As described above, the first duration time A of the first transition operation after the fixing devices 100 and 1005 are powered on, that is, after the main power switch 91 is turned on, is longer than the second duration time B of the second transition operation or later, thus supplying a sufficient amount of heat to the nip formation set 45. Accordingly, the temperature of the nip formation set 45 does not decrease during the first transition operation, that is, while the fixing devices 100 and 100S wait for the second fixing operation. Consequently, the nip formation set 45 does not draw heat from the fixing belt 121 during the second fixing operation subsequent to the first transition operation, minimizing temperature decrease of the fixing belt 121. As a result, cold offset does not occur during the second fixing operation subsequent to the first transition operation.

According to the exemplary embodiments described above, the pressing roller 122 serves as a pressing rotary body disposed opposite the fixing belt 121. Alternatively, a pressing belt or the like may serve as a pressing rotary body.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device comprising:

a pressing rotary body rotatable in a predetermined direction of rotation;

a hollow, endless rotary body contacting the pressing rotary body and rotatable in a direction counter to the direction of rotation of the pressing rotary body;

a heater disposed opposite and heating the endless rotary body;

a nip formation assembly disposed opposite an inner circumferential surface of the endless rotary body and pressing against the pressing rotary body via the endless rotary body to form a fixing nip between the endless rotary body and the pressing rotary body where first and second recording media bearing a toner image pass and receive heat and pressure from the endless rotary body and the pressing rotary body that fix the toner image on the first and second recording media; and a controller operatively connected to the heater and at least one of the pressing rotary body and the endless rotary body to perform:

a first fixing operation to fix the toner image on the first recording medium after the fixing device is powered on;

a first transition operation, subsequent to a last recording medium in a first fixing job that includes the first fixing operation having passed through the fixing nip, in which the controller rotates the pressing rotary body and the endless rotary body while controlling the heater to maintain the endless rotary body at a predetermined temperature;

a second fixing operation, subsequent to the first transition operation, to fix the toner image on the second recording medium; and a second transition operation, subsequent to a last recording medium in a second fixing job that includes the second fixing operation having passed through the fixing nip, in which the controller rotates the pressing rotary body and the endless rotary body while controlling the heater to maintain the endless rotary body at the predetermined temperature, the controller to set a first duration time for which the first transition operation is performed to be greater than a second duration time for which the second transition operation is performed.

2. The fixing device according to claim 1, further comprising an adjuster operatively connected to the controller to change the first duration time and the predetermined temperature of the endless rotary body.

3. The fixing device according to claim 2, wherein the adjuster includes a control panel operated by a user.

4. The fixing device according to claim 1, wherein the first duration time is about 60 seconds and the second duration time is 15 seconds.

5. The fixing device according to claim 1, wherein after the first transition operation or the second transition operation, the controller turns off the heater and halts the pressing rotary body and the endless rotary body.

6. The fixing device according to claim 1, wherein after the first transition operation or the second transition operation, the controller controls the heater to heat the endless rotary body to a decreased temperature smaller than the predetermined temperature.

7. The fixing device according to claim 6, wherein the predetermined temperature is 158 degrees centigrade and the decreased temperature is 90 degrees centigrade.

8. The fixing device according to claim 1, wherein when the controller receives an instruction to start the second fixing operation during the first transition operation, the controller quits the first transition operation and starts the second fixing operation.

9. The fixing device according to claim 1, wherein the heater heats the endless rotary body directly by radiation heat.

10. The fixing device according to claim 1, further comprising a stay contacting and supporting the nip formation assembly.

11. The fixing device according to claim 10, wherein the stay houses the heater.

12. The fixing device according to claim 1, wherein the heater includes a halogen heater.

13. The fixing device according to claim 1, wherein the endless rotary body includes a fixing belt and the pressing rotary body includes a pressing roller.

14. An image forming apparatus comprising the fixing device according to claim 1.

15. A fixing method performed by a fixing device including an endless rotary body and a pressing rotary body pressed against the endless rotary body to form a fixing nip, the fixing method comprising:

powering on the fixing device;

rotating the pressing rotary body and the endless rotary body;

heating the endless rotary body to a predetermined temperature;

performing a first fixing operation for conveying a first recording medium bearing a toner image between the endless rotary body and the pressing rotary body;

performing, subsequent to a last recording medium in a first fixing job that includes the first fixing operation having passed through the fixing nip, a first transition operation for rotating the pressing rotary body and the endless rotary body while maintaining the endless rotary body at the predetermined temperature for a first duration time;

performing a second fixing operation for conveying a second recording medium bearing a toner image between the endless rotary body and the pressing rotary body; and performing, subsequent to a last recording medium in a second fixing job that includes the second fixing operation having passed through the fixing nip, a second transition operation for rotating the pressing rotary body and the endless rotary body while maintaining the endless rotary body at the predetermined temperature for a second duration time smaller than the first duration time.

16. The fixing method according to claim 15, further comprising:

stopping heating the endless rotary body and halting the pressing rotary body and the endless rotary body after the first fixing operation or the second fixing operation.

17. The fixing method according to claim 15, further comprising:

heating the endless rotary body to a decreased temperature smaller than the predetermined temperature after the first transition operation or the second transition operation.

18. The fixing method according to claim 15, further comprising:

quitting the first transition operation and starting the second fixing operation when the fixing device receives an instruction to start the second fixing operation during the first transition operation.

19. The fixing method according to claim 15, further comprising:

changing the first duration time and the predetermined temperature of the endless rotary body.

20. A fixing device comprising:

a pressing rotary body rotatable in a predetermined direction of rotation;

a hollow, endless rotary body contacting the pressing rotary body and rotatable in a direction counter to the direction of rotation of the pressing rotary body;

a heater disposed opposite and heating the endless rotary body;

a nip formation assembly disposed opposite an inner circumferential surface of the endless rotary body and pressing against the pressing rotary body via the endless rotary body to form a fixing nip between the endless rotary body and the pressing rotary body where first and second recording media bearing a toner image pass and receive heat and pressure from the endless rotary body and the pressing rotary body that fix the toner image on the first and second recording media; and a controller operatively connected to the heater and at least one of the pressing rotary body and the endless rotary body to perform:

a first fixing operation to fix the toner image on the first recording medium after the fixing device is powered on;

a first transition operation, subsequent to the first fixing operation, in which the controller rotates the pressing rotary body and the endless rotary body while controlling the heater to maintain the endless rotary body at a predetermined temperature;

a second fixing operation, subsequent to the first transition operation, to fix the toner image on the second recording medium; and a second transition operation, subsequent to the second fixing operation, in which the controller rotates the pressing rotary body and the endless rotary body while controlling the heater to maintain the endless rotary body at the predetermined temperature, the controller to set a first duration time for which the first transition operation is performed to be greater than a second duration time for which the second transition operation is performed, and wherein when the controller receives an instruction to start the second fixing operation during the first transition operation, the controller quits the first transition operation and starts the second fixing operation.

* * * * *